US006488349B1

(12) United States Patent
Matsuo et al.

(10) Patent No.: US 6,488,349 B1
(45) Date of Patent: Dec. 3, 2002

(54) INK-JET HEAD AND INK-JET TYPE RECORDING APPARATUS

(75) Inventors: Koji Matsuo, Fukuoka (JP); Koji Ikeda, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 12 days.

(21) Appl. No.: 09/856,347

(22) PCT Filed: Sep. 18, 2000

(86) PCT No.: PCT/JP00/06338

§ 371 (c)(1),
(2), (4) Date: May 18, 2001

(87) PCT Pub. No.: WO01/21408

PCT Pub. Date: Mar. 29, 2001

(30) Foreign Application Priority Data

Sep. 21, 1999 (JP) ..... 11-266850
Nov. 22, 1999 (JP) ..... 11-330906

(51) Int. Cl.[7] ..... B41J 29/38
(52) U.S. Cl. ..... 347/11; 347/9
(58) Field of Search ..... 347/9–11, 37

(56) References Cited

U.S. PATENT DOCUMENTS 6,022,092 A * 2/2000 Misumi ..... 347/10
6,059,393 A * 5/2000 Takahashi ..... 347/11
6,079,806 A * 6/2000 Wen et al. ..... 347/10
6,151,050 A * 11/2000 Hosono et al. ..... 347/70
6,364,444 B1 * 4/2002 Ota ..... 347/10

FOREIGN PATENT DOCUMENTS

| | | | |
|---|---|---|---|
| EP | 115180 | 8/1984 | ..... B41J/3/04 |
| EP | 827838 | 3/1998 | ..... B41J/2/27 |
| EP | 916505 | 5/1999 | ..... B41J/12/29 |
| JP | 05016359 A | 1/1993 | ..... B41J/2/045 |
| JP | 6-320723 | 11/1994 | ..... B41J/21/56 |
| JP | 07132604 A | 5/1995 | ..... B41J/2/05 |
| JP | 08336970 A | 12/1996 | ..... B41J/2/045 |
| JP | 10264370 A | 10/1998 | ..... B41J/2/01 |
| JP | 10278275 A | 10/1998 | ..... B41J/2/06 |
| JP | 11254685 A | 9/1999 | ..... B41J/2/06 |
| JP | 11254686 A | 9/1999 | ..... B41J/2/12 |
| JP | 11277730 A | 10/1999 | ..... B41J/2/01 |
| JP | 11277744 A | 10/1999 | ..... B41J/2/049 |

* cited by examiner

*Primary Examiner*—John Barlow
*Assistant Examiner*—Alfred E. Dudding
(74) *Attorney, Agent, or Firm*—Harness, Dickey & Pierce, P.L.C.

(57) ABSTRACT

A plurality of ink droplets are discharged from the same nozzle during one printing cycle so as to perform multiple gray level printing. A group of driving pulses including an initial pulse P1, a first subsequent pulse P2 and a second subsequent pulse P3 in one printing cycle is supplied to an actuator. Time intervals t1, t2 and t3 between pulses are set to satisfy t1≦t2<t3≦t0 with respect to the natural period t0 of the actuator.

31 Claims, 17 Drawing Sheets

INK-JET HEAD AND INK-JET TYPE RECORDING APPARATUS

TECHNICAL FIELD

The present invention relates to an ink jet head and an ink jet type recording apparatus.

BACKGROUND ART

In recent years, there has been proposed an ink jet type recording apparatus which discharges, during one printing cycle for forming a single dot on recording paper, a plurality of ink droplets from the same nozzle of an ink jet head so as to form a single dot by the plurality of ink droplets, as disclosed in, for example, Japanese Laid-Open Patent Publication No. 10-81012.

An ink jet type recording apparatus of this type includes an ink jet head for discharging ink droplets and relative movement means for relatively moving the ink jet head and the recording paper with respect to each other. The ink jet head includes a head body which is provided with a pressure chamber containing ink and a nozzle, an actuator for discharging the ink in the pressure chamber through the nozzle, and driving signal supply means for supplying driving signals to the actuator.

While the ink jet head and the recording paper are relatively moved with respect to each other by the relative movement means, the driving signal supply means supplies a driving signal including one or more driving pulses during one printing cycle. The actuator is actuated by receiving the driving signal so as to discharge one or more ink droplets through the nozzle. The ink droplets thus discharged strike the recording paper in the order they are discharged so as to form a single ink dot. A predetermined image is formed on the recording paper by a collection of a large number of such ink dots on the recording paper. In this process, the number of ink droplets to be discharged during one printing cycle is adjusted so as to adjust the gradation and the size of the dot, thereby realizing so-called "multiple gray level printing".

In order to discharge one or more ink droplets during one printing cycle as described above, it is necessary to supply to the actuator a number of driving pulses corresponding to the number of ink droplets to be discharged. However, it is difficult to form a desirable ink dot on the recording paper simply by supplying a number of driving pulses corresponding to the number of ink droplets to be discharged without elaborating the driving signal.

For example, when performing high-speed printing, the speed of the relative movement of the ink jet head and the recording paper is high, whereby it is likely that a plurality of ink droplets discharged from the same nozzle strike the recording paper at positions shifted from each other. As a result, it is likely that the ink dot has an oblong circle shape, thereby deteriorating the printing quality. Therefore, in such a case, it is necessary to successively discharge a plurality of ink droplets so that the ink droplet discharging interval is reduced as much as possible, and to discharge the ink droplets so that each later discharged ink droplet is discharged with a higher discharge velocity than that of the previously discharged ink droplet. Thus, a new technique for precisely discharging ink droplets successively with higher velocities in the order they are discharged has been longed for.

On the other hand, there has also been proposed a method in which two ink droplets discharged from the same nozzle are allowed to merge in flight into a single ink droplet before striking, as disclosed in, for example, U.S. Pat. No. 5,285,215 or Japanese Patent Publication for Opposition No. 7-108568. In such a method, it is necessary to elaborate, particularly, the driving signal. In the apparatus disclosed in Japanese Patent Publication for Opposition No. 7-108568, it is made possible to change the discharge velocity of an ink droplet by changing the inclination angle of the trailing edge portion of a driving pulse.

However, supplying a driving signal including a plurality of driving pulses whose trailing edge portions have different inclination angles to the actuator has complicated the driving signal supply means and increased the cost thereof. In such a background, a new technique for merging a plurality of ink droplets before striking using a driving signal of a simple waveform has been longed for.

Moreover, if the meniscus vibration of ink upon completion of one printing cycle remains in the next printing cycle, the ink discharging performance will be unstable. In view of this, a method for supplying a driving signal which is less susceptible to the adverse influence of the meniscus vibration has been longed for.

The present invention has been made in view of the above, and has an object to improve the ink discharging performance of an ink jet head which discharges one or more ink droplets from the same nozzle during one printing cycle, and the ink discharging performance of an ink jet type recording apparatus incorporating the same.

DISCLOSURE OF THE INVENTION

An ink jet head according to the present invention includes: a head body which is provided with a pressure chamber containing ink and a nozzle communicated to the pressure chamber; an actuator having a piezoelectric element for applying a pressure on the ink in the pressure chamber by a piezoelectric effect of the piezoelectric element; and driving signal supply means for supplying a driving voltage signal including a plurality of driving pulses to the piezoelectric element of the actuator, wherein the driving signal supply means supplies the plurality of driving pulses during one predetermined printing cycle so that a time interval between the driving pulses gradually approaches a natural period of the actuator.

Note that the natural period of the actuator as used herein refers to the natural period of the entire vibration system including an acoustic element (specifically, the ink).

Thus, a plurality of driving pulses are supplied to the piezoelectric element of the actuator during one printing cycle, thereby discharging a plurality of ink droplets from the same nozzle. Now, the time interval of the plurality of driving pulses gradually approaches the natural period of the actuator, whereby the discharge velocity of the plurality of ink droplets discharged from the nozzle gradually increases. Therefore, a later discharged ink droplet has a higher discharge velocity than that of a previously discharged ink droplet. Then, the later discharged ink droplet catches up with the previously discharged ink droplet, and the ink droplets merge before striking the recording medium. As a result, the plurality of ink droplets merge into a single ink droplet and then strike the recording medium, thereby forming a desirable single dot on the recording medium.

It is preferred that the driving signal supply means supplies the plurality of driving pulses so that the time interval between the driving pulses gradually increases.

Thus, the time interval of the driving pulse gradually increases so as to approach the natural period of the actuator, whereby the overall time interval of the driving pulses is shorter than that when the time interval gradually decreases so as to approach the natural period. Therefore, it is possible to reduce the printing cycle, thereby enabling printing at a higher speed.

In the ink jet head described above, the driving voltage signal may include a negative pressure potential for driving the actuator to depressurize the pressure chamber, and a positive pressure potential for driving the actuator to pressurize the pressure chamber; and the plurality of driving pulses may include: an initial driving pulse composed of a potential decreasing waveform which decreases from a predetermined reference potential between a negative pressure potential and a positive pressure potential to the negative pressure potential, a negative pressure potential holding waveform which holds the negative pressure potential, and a potential increasing waveform which increases from the negative pressure potential to the positive pressure potential; and one or more subsequent driving pulses each composed of a positive pressure potential holding waveform which holds a positive pressure potential, a potential decreasing waveform which decreases from the positive pressure potential to a negative pressure potential, a negative pressure potential holding waveform which holds the negative pressure potential, and a potential increasing waveform which increases from the negative pressure potential to a positive pressure potential.

Thus, so-called pull-push type ink discharge is performed in which the actuator is once driven to be depressurized and then driven to be pressurized so as to discharge the ink.

The driving signal supply means may be configured so as to sequentially supply at least the initial driving pulse, a first subsequent driving pulse and a second subsequent driving pulse during one printing cycle; and a first time $t1$ from a start of potential decrease in the potential decreasing waveform to an end of potential increase in the potential increasing waveform in the initial driving pulse, a second time $t2$ from a start of potential holding in a positive pressure potential holding waveform to an end of potential increase in a potential increasing waveform in the first subsequent driving pulse, and a third time $t3$ from a start of potential holding in a positive pressure potential holding waveform to an end of potential increase in a potential increasing waveform in the second subsequent driving pulse, may be set to satisfy $t1 \leqq t2 < t3 \leqq t0$ with respect to the natural period $t0$ of the actuator.

Thus, the first ink droplet discharged by the initial driving pulse, the second ink droplet discharged by the first subsequent driving pulse, and the third ink droplet discharged by the second subsequent driving pulse, merge before striking the recording medium, thereby forming a single dot on the recording medium. As a result, a desirable single dot is formed on the recording medium, and high-speed printing is enabled.

The positive pressure potential of the initial driving pulse and the positive pressure potential of each of the subsequent driving pulses may be equal to each other; and the negative pressure potential of the initial driving pulse and the negative pressure potential of each of the subsequent driving pulses may be equal to each other.

Thus, a plurality of driving pulses are formed by three levels of potential, i.e., the predetermined positive pressure potential, the predetermined reference potential, and the predetermined negative pressure potential. Therefore, the driving pulses can be easily formed.

It is preferred that a time $T1$ from a start of potential decrease in the potential decreasing waveform of the initial driving pulse to an end of potential increase in a potential increasing waveform of a last subsequent driving pulse in one printing cycle is set to satisfy $T1/T2 \leqq 0.5$ with respect to a minimum printing cycle $T2$.

Thus, a sufficient time for settling down the ink in the pressure chamber is ensured between when the last subsequent driving pulse is supplied and when the initial driving pulse of the next printing cycle is supplied. Therefore, the ink discharge is stabilized.

With an actuator whose natural period is relatively long, the influence of the waveform holding time of the potential holding waveform of a driving pulse on the ink discharge velocity is relatively small. Therefore, by shortening the potential holding waveform, the potential increasing waveform or the potential decreasing waveform can be elongated accordingly.

In view of this, it is preferred that a pulse width of each of the driving pulses is set to be less than or equal to the natural period of the actuator; and a waveform holding time of a potential holding waveform of each of the driving pulses is set to be less than or equal to ¼ of the natural period of the actuator.

Thus, the rising time of the potential increasing waveform or the falling time of the potential decreasing waveform is sufficiently ensured, thereby realizing stable ink discharge without extra dots. Note that the waveform holding time may be zero. In other words, the waveform holding time may be 0 to ¼ times the natural period.

Alternatively, in the ink jet head described above, the plurality of driving pulses may include three or more rectangular driving pulses each composed of a potential increasing waveform which increases from a predetermined reference potential to a positive pressure potential for driving the actuator to pressurize the pressure chamber, a positive pressure potential holding waveform which holds the positive pressure potential, and a potential decreasing waveform which decreases from the positive pressure potential to a predetermined reference potential.

Thus, three or more rectangular driving pulses are supplied to the actuator during one printing cycle so that three or more ink droplets are discharged from the nozzle so that the discharge velocity gradually increases. As a result, the ink droplets merge before striking the recording medium, so that they strike the recording medium after merging into a single ink droplet. Therefore, a desirable single dot is formed on the recording medium, and high-speed printing is enabled.

The driving signal supply means may be configured so as to sequentially supply at least first, second and third rectangular driving pulses during one printing cycle; and a first time $t1$ from an end potential increase in the first driving pulse to an end of potential increase in the second driving pulse, and a second time $t2$ from an end of potential increase in the second driving pulse to an end of potential increase in the third driving pulse, may be set to satisfy $t1 < t2 \leqq t0$ with respect to the natural period $t0$ of the actuator.

Thus, the first ink droplet discharged by the first driving pulse, the second ink droplet discharged by the second driving pulse, and the third ink droplet discharged by the third driving pulse, merge before striking the recording medium, thereby forming a single dot on the recording medium.

The rectangular driving pulses may have an equal positive pressure potential and an equal reference potential.

Thus, the driving pulses can be formed by only two potentials, whereby the driving pulses can be formed easily.

It is preferred that a time T1 from a start of potential increase in a first driving pulse to a start of potential increase in a last driving pulse in one printing cycle is set to satisfy $T1/T2 \leqq 0.5$ with respect to a minimum printing cycle T2.

Thus, a sufficient time for settling down the ink in the pressure chamber is ensured between when the last driving pulse is supplied and when the first driving pulse of the next printing cycle is supplied. Therefore, the ink discharge is stabilized.

Another ink jet head according to the present invention includes a head body which is provided with a pressure chamber containing ink and a nozzle communicated to the pressure chamber; an actuator having a piezoelectric element for applying a pressure on the ink in the pressure chamber by a piezoelectric effect of the piezoelectric element; and driving signal supply means for supplying a driving voltage signal to the piezoelectric element of the actuator, wherein: the driving signal supply means is configured so as to supply a plurality of driving pulses during one predetermined printing cycle; and a time interval between the driving pulses increases so as to gradually approach a predetermined time which is slightly longer than a natural period of the actuator so that a later discharged ink droplet has a higher discharge velocity than that of a previously discharged ink droplet.

When a plurality of driving pulses are successively supplied within a short period of time, the influence of the vibration of the actuator or the pulsation of the ink from a preceding driving pulse may remain, thereby influencing the actuation of the actuator by a subsequent driving pulse. As a result, there are cases where the ink discharge velocity is higher if the time interval between driving pulses is set to be equal to a predetermined time which is slightly longer than the natural period of the actuator than that obtained if it is set to be equal to the natural period. Therefore, in such cases, the discharge velocity of the ink droplets may be increased in the order they are discharged so that the ink droplets merge before striking by gradually increasing the time interval between driving pulses so that the time interval approaches a predetermined time which is slightly longer than the natural period as described above.

Another ink jet head according to the present invention includes a head body which is provided with a pressure chamber containing ink and a nozzle communicated to the pressure chamber; an actuator having a piezoelectric element for applying a pressure on the ink in the pressure chamber by a piezoelectric effect of the piezoelectric element; and driving signal supply means for supplying a driving voltage signal to the piezoelectric element of the actuator, wherein: the driving signal supply means is configured so as to supply a plurality of driving pulses during one predetermined printing cycle; and the plurality of driving pulses are supplied in such an order that a pulse width thereof gradually approaches a time which is equal to, or approximately equal to, one half of a natural period of the actuator so that a later discharged ink droplet has a higher discharge velocity than that of a previously discharged ink droplet.

Thus, a plurality of driving pulses are supplied to the piezoelectric element of the actuator during one printing cycle, thereby discharging a plurality of ink droplets from the same nozzle. Now, since the pulse width of the driving pulse gradually approaches the time which is equal to, or approximately equal to, one half of the natural period of the actuator, the discharge velocity of the ink droplets discharged from the nozzle gradually increases in the order they are discharged. Therefore, a later discharged ink droplet catches up with a previously discharged ink droplet, whereby the ink droplets merge before striking the recording medium. As a result, the plurality of ink droplets merge into a single ink droplet and then strike the recording medium, thereby forming a desirable single dot on the recording medium.

The driving voltage signal may include a negative pressure potential for driving the actuator to depressurize the pressure chamber, and a positive pressure potential for driving the actuator to pressurize the pressure chamber; and the plurality of driving pulses may include: an initial driving pulse composed of a potential decreasing waveform which decreases from a predetermined reference potential between a negative pressure potential and a positive pressure potential to the negative pressure potential, a negative pressure potential holding waveform which holds the negative pressure potential, and a potential increasing waveform which increases from the negative pressure potential to the positive pressure potential; and one or more subsequent driving pulses each composed of a positive pressure potential holding waveform which holds a positive pressure potential, a potential decreasing waveform which decreases from the positive pressure potential to a negative pressure potential, a negative pressure potential holding waveform which holds the negative pressure potential, and a potential increasing waveform which increases from the negative pressure potential to a positive pressure potential.

Alternatively, the driving voltage signal may include a predetermined reference potential, and a negative pressure potential for driving the actuator to depressurize the pressure chamber; and the plurality of driving pulses may include three or more driving pulses each composed of a potential decreasing waveform which decreases from a reference potential to a negative pressure potential, a negative pressure potential holding waveform which holds the negative pressure potential, and a potential increasing waveform which increases from the negative pressure potential to a reference potential.

Thus, so-called pull-push (pull and push) type ink discharge is performed, whereby a plurality of ink droplets are discharged during one printing cycle. Since the pulse width of the driving pulse gradually approaches the time which is equal to, or approximately equal to, one half of the natural period of the actuator, the plurality of ink droplets merge before striking, so that they strike the recording medium after merging into a single ink droplet.

Moreover, the plurality of driving pulses may include three or more rectangular driving pulses each composed of a potential increasing waveform which increases from a predetermined reference potential to a positive pressure potential for driving the actuator to pressurize the pressure chamber, a positive pressure potential holding waveform which holds the positive pressure potential, and a potential decreasing waveform which decreases from the positive pressure potential to the reference potential.

Thus, three or more rectangular driving pulses are supplied to the actuator during one printing cycle, whereby three or more ink droplets are discharged from the nozzle so that the discharge velocity thereof gradually increases. As a result, the ink droplets merge before striking the recording medium, so that they strike the recording medium after merging into a single ink droplet.

It is preferred that the plurality of driving pulses are supplied in such an order that a pulse width thereof gradually increases.

Thus, the pulse width of the driving pulse gradually increases so as to approach the time which is equal to, or approximately equal to, one half of the natural period, whereby the time obtained as the total pulse width of the driving pulses is shorter than that when the pulse width gradually decreases so as to approach the time. Therefore, the printing cycle can be reduced, and printing at a higher speed is enabled.

Another ink jet head according to the present invention includes: a head body which is provided with a plurality of pressure chambers containing ink and a plurality of nozzles communicated to the pressure chambers, respectively; a plurality of actuators each having a piezoelectric element for applying a pressure on the ink in the respective pressure chambers by a piezoelectric effect of the piezoelectric element; a driving signal production section for producing a reference driving signal including, in one predetermined printing cycle, N (N is a natural number equal to or greater than 2) ink discharging pulse signals for driving the actuators so as to discharge ink droplets from the nozzles; and a signal selection section for selectively supplying, to one of the actuators, P (P is a natural number less than or equal to N) ink discharging pulse signals included in the reference driving signal, wherein: the ink discharging pulse signals of the reference driving signal are formed so that a later discharged ink droplet has a higher discharge velocity than that of a previously discharged ink droplet; and the signal selection section is configured so as to supply $N-P+1^{th}$ and subsequent ink discharging pulse signals of the reference driving signal.

Thus, the driving signal production section produces a reference driving signal including N ink discharging pulse signals so that a maximum of N ink droplets can be discharged during one printing cycle. On the other hand, the signal selection section selects, and supplies to the actuator, a total of P ink discharging pulse signals, i.e., the $N-P+1^{th}$ and subsequent signals, of the N ink discharging pulse signals so as to discharge P ink droplets during one printing cycle, according to a predetermined image signal. Now, since the P ink discharging pulse signals are pulse signals which have been successively produced in the reference driving signal, the time interval between the pulses is short. Therefore, the P ink droplets will be successively discharged one right after another. Moreover, the N ink discharging pulse signals are formed so that a later discharged ink droplet has a higher discharge velocity than that of a previously discharged ink droplet, whereby the total of P ink droplets, which are discharged by the P ink discharging pulse signals, are discharged so that the discharge velocity thereof successively increases. Therefore, there is only a little displacement among the positions at which the P ink droplets strike, and merging the P ink droplets before striking is facilitated. Thus, irrespective of the number of ink droplets to be discharged, a desirable ink dot is formed and the ink discharging performance is improved.

Moreover, the driving signal produced by the driving signal production section for discharging the ink is only one kind of reference driving signal, and it is therefore not necessary to separately produce a number of driving signals according to the number of ink discharges. Thus, the configuration of the control system is simplified, and the cost is reduced.

It is preferred that the driving signal production section produces an auxiliary pulse signal for suppressing meniscus vibration of the ink in the head body after producing the reference driving signal; and the signal selection section is configured so as to supply, to one of the actuators, the $N-P+1^{th}$ and subsequent ink discharging pulse signals and the auxiliary pulse signal.

Thus, an auxiliary pulse signal is supplied to the actuator after a total of P ink discharging pulse signals, i.e., the $N-P+1^{th}$ and subsequent signals, of the reference driving signal are supplied thereto. As a result, the meniscus vibration of the ink after discharging the P ink droplets is suppressed, and the ink discharging performance in the next printing cycle is stabilized.

Another ink jet head according to the present invention includes: a head body which is provided with a plurality of pressure chambers containing ink and a plurality of nozzles communicated to the pressure chambers, respectively; a plurality of actuators each having a piezoelectric element for applying a pressure on the ink in the respective pressure chambers by a piezoelectric effect of the piezoelectric element; a driving signal production section for producing a reference driving signal including, in one predetermined printing cycle, N (N is a natural number equal to or greater than 2) ink discharging pulse signals for driving the actuators so as to discharge ink droplets from the nozzles; and a signal selection section for selectively supplying, to one of the actuators, P (P is a natural number less than or equal to N) ink discharging pulse signals included in the reference driving signal, wherein: the ink discharging pulse signals of the reference driving signal are formed so that a later discharged ink droplet has a higher discharge velocity than that of a previously discharged ink droplet; the driving signal production section produces an auxiliary pulse signal for suppressing meniscus vibration of the ink in the head body after producing the reference driving signal; and the signal selection section is configured so as to supply the first ink discharging pulse signal of the reference driving signal when P is 1, and to supply the $N-P+1^{th}$ and subsequent ink discharging pulse signals of the reference driving signal and the auxiliary pulse signal when P is equal to or greater than 2.

Thus, in a case where one (P=1) ink droplet is discharged during one printing cycle, only the first pulse signal of the N ink discharging pulse signals included in the reference driving signal is supplied to the actuator. The first pulse signal has a stable waveform as compared to those of the second and subsequent pulse signals, and it is produced in the earliest period in the printing cycle, whereby the ink discharging timing is precise while the ink discharging performance is stabilized and the precision of the position at which the ink strikes is improved. Note that in such a case, since only one ink droplet is discharged, the overall amount of ink discharged during one printing cycle is small, and the influence of the meniscus vibration is small. Therefore, there is no problem even if the auxiliary pulse signal is not supplied. Moreover, even in a case where two or more ($P \geqq 2$) ink droplets are discharged during one printing cycle, a desirable ink dot is formed irrespective of the number of ink droplets to be discharged, and the ink discharging performance is improved, for the reasons described above. Note that in such a case, an auxiliary pulse signal is supplied to the actuator after the reference driving signal is supplied thereto, thereby suppressing the deterioration in the discharging performance due to the influence of the meniscus vibration.

It is preferred that an interval between the $N^{th}$ ink discharging pulse signal of the reference driving signal and the auxiliary pulse signal is set to be 0.5 to 1.5 times a natural period of the actuators. Note that the natural period of the actuator refers to the natural period of the entire vibration system including an acoustic element (specifically, the ink).

Thus, the meniscus vibration of the ink is efficiently suppressed.

While it is difficult to sufficiently suppress the meniscus vibration when the potential difference of the auxiliary pulse signal is too small, an unintended ink discharge may occur when the potential difference is too large. In view of this, it is preferred that a potential difference of the auxiliary pulse signal is set to be 0.1 to 0.3 times a minimum potential difference of the ink discharging pulse signals of the reference driving signal.

Thus, there is obtained an auxiliary pulse signal which is suitable for efficiently suppressing the meniscus vibration without discharging the ink.

Each ink discharging pulse signal of the reference driving signal may be composed of a rectangular or trapezoidal pulse signal having a first potential as a reference potential and a second potential which is different from the first potential; the signal selection section may be comprised of a switching circuit which is selectively switched to either one of an ON state where the reference driving signal is supplied to one of the actuators and an OFF state where the supply of the reference driving signal to the actuator is stopped; and the switching circuit may be configured so as to be switched from the OFF state to the ON state while a potential of the reference driving signal is at the first potential.

Thus, the ink discharging pulse signals of the reference driving signal are composed of rectangular or trapezoidal pulse signals with only two potentials, i.e., the first potential and the second potential, whereby the waveform of the reference driving signal is simplified. Therefore, the configuration of the driving signal production section for producing the reference driving signal is simplified.

The ink discharging pulse signals of the reference driving signal may be each composed of: an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials; the signal selection section may be comprised of a switching circuit which is selectively switched to either one of an ON state where the reference driving signal is supplied to one of the actuators and an OFF state where the supply of the reference driving signal to the actuator is stopped; and the switching circuit may be configured so as to be switched from the OFF state to the ON state after passage of a predetermined time from a start of waveform holding in the negative pressure potential holding waveform of the reference driving signal so that the supply of the reference driving signal is started after a potential of the reference driving signal has transitioned to the negative pressure potential.

Thus, the switching circuit is switched from the OFF state to the ON state after passage of a predetermined time from the start of waveform holding of the negative pressure potential holding waveform of the reference driving signal so that it is switched with a predetermined time delay from the falling transition of the waveform of the reference driving signal. Therefore, the switching circuit is not switched while the potential of the reference driving signal is decreasing, whereby no unstable driving signal including a holding waveform of an unintended potential other than the reference potential, the negative pressure potential and the positive pressure potential is supplied to the actuator.

Each ink discharging pulse signal of the reference driving signal may be composed of a potential decreasing waveform which decreases from a reference potential to a negative pressure potential for driving one of the actuators to depressurize one of the pressure chambers, a negative pressure potential holding waveform which holds the negative pressure potential, and a potential increasing waveform which increases from the negative pressure potential to the reference potential; the auxiliary pulse signal may be composed of a potential decreasing waveform which decreases from the reference potential to an auxiliary negative pressure potential for driving one of the actuators to depressurize one of the pressure chambers, a negative pressure potential holding waveform which holds the auxiliary negative pressure potential, and a potential increasing waveform which increases from the auxiliary negative pressure potential to the reference potential; and an interval between an end of potential increase in the potential increasing waveform in the $N^{th}$ ink discharging pulse signal of the reference driving signal and a start of potential decrease in the potential decreasing waveform of the auxiliary pulse signal may be set to be 0.5 to 1 times a natural period of the actuators.

Thus, it is possible to realize stable ink discharge by using a reference driving signal having potential holding waveforms for two potentials (the reference potential and the negative pressure potential) and utilizing the ink discharging function and the meniscus vibration suppressing function based on the so-called pull-push operation of the actuator.

The ink discharging pulse signals of the reference driving signal may be each composed of: an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials; the auxiliary pulse signal may be composed of a potential decreasing waveform which decreases from the reference potential to an auxiliary negative pressure potential for driving one of the actuators to depressurize one of the pressure chambers, a negative pressure potential holding waveform which holds the auxiliary negative pressure potential, and a potential increasing waveform which increases from the auxiliary negative pressure potential to the reference potential; and an interval between an end of potential increase in the potential increasing waveform in the last subsequent pulse signal of the reference driving signal and a start of potential decrease in the potential decreasing waveform of the auxiliary pulse signal may be set to be 0.5 to 1 times a natural period of the actuators.

Thus, it is possible to realize stable ink discharge by using a reference driving signal having potential holding waveforms for three potentials (the reference potential, the negative pressure potential and the positive pressure potential) and utilizing the ink discharging function and the meniscus vibration suppressing function based on the so-called pull-push operation of the actuator.

The ink discharging pulse signals of the reference driving signal may be each composed of: an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials; the auxiliary pulse signal may be composed of a potential increasing waveform which increases from the reference potential to an auxiliary pressurizing potential for driving one of the actuators to pressurize one of the pressure chambers, a positive pressure potential holding waveform which holds the auxiliary positive pressure potential, and a potential decreasing waveform which decreases from the auxiliary positive pressure potential to the reference potential; and an interval between an end of potential increase in the potential increasing waveform in the last subsequent pulse signal of the reference driving signal and a start of potential increase in the potential increasing waveform of the auxiliary pulse signal may be set to be 1 to 1.5 times a natural period of the actuators.

Thus, it is possible to realize stable ink discharge by using a reference driving signal having potential holding waveforms for three potentials (the reference potential, the negative pressure potential and the positive pressure potential) and utilizing the ink discharging function based on the so-called pull-push operation of the actuator and the meniscus vibration suppressing function based on the so-called push-pull operation.

The ink discharge velocity is higher as the interval between the ink discharging pulse signals supplied to the actuator is closer to the natural period of the actuator. In view of this, the reference driving signal may be formed so that an interval between the N ink discharging pulse signals gradually approaches a natural period of the actuators while gradually increasing.

Thus, a later discharged ink droplet has a higher discharge velocity than that of a previously discharged ink droplet, thereby obtaining a specific preferable reference driving signal.

On the other hand, the ink discharge velocity is higher as the pulse height (potential difference) of the ink discharging pulse signal supplied to the actuator is greater. In view of this, the reference driving signal may be formed so that a potential differences in the N ink discharging pulse signals gradually increase.

Thus, a later discharged ink droplet has a higher discharge velocity than that of a previously discharged ink droplet, thereby obtaining a specific preferable reference driving signal.

The thickness of the piezoelectric element may be set to be 0.5 $\mu$m to 5 $\mu$m. Also when the piezoelectric element is thus provided as a thin film, a desirable dot is formed on the recording medium.

An ink jet type recording apparatus according to the present invention includes: the ink jet head as described above; and relative movement means for relatively moving the ink jet head and a recording medium with respect to each other while the ink jet head discharges ink.

Thus, it is possible to obtain an ink jet type recording apparatus with an excellent ink discharging performance.

As described above, according to the present invention, a plurality of driving pulses are supplied to the actuator, and the time interval between the pulses is set so as to gradually approach the natural period of the actuator or a predetermined time which is slightly longer than the natural period, whereby it is possible to discharge a plurality of ink droplets so that the discharge velocity thereof gradually increases. Thus, it is possible to merge a plurality of ink droplets before striking the recording medium, so that they strike the recording medium as a single ink droplet. Therefore, a desirable single dot can be formed on the recording medium from a plurality of ink droplets. As a result, the printing quality and/or the printing speed can be improved.

In such a case, by gradually increasing the time interval of the driving pulse, it is possible to reduce the time of one printing cycle and to increase the speed of printing.

Moreover, according to the present invention, a plurality of driving pulses are supplied to the actuator, and the pulse width thereof is set so as to gradually approach a time which is equal to, or approximately equal to, one half of the natural period of the actuator, whereby it is possible to discharge a plurality of ink droplets so that the discharge velocity thereof gradually increases. Thus, it is possible to merge a plurality of ink droplets so that they strike the recording medium as a single ink droplet, and to improve the printing quality and/or the printing speed.

In such a case, by gradually increasing the pulse width of the driving pulse, it is possible to reduce the time of one printing cycle and to increase the speed of printing.

Moreover, according to the present invention, in a case where P ink droplets are discharged during one printing cycle, a reference driving signal including N pulse signals is produced in the driving signal production section, and the $N-P+1^{th}$ and subsequent pulse signals of the reference driving signal are supplied to the actuator, whereby a desirable ink dot can be formed on the recording medium from a plurality of ink droplets.

Moreover, according to the present invention, the first pulse signal of the reference driving signal is supplied when P is 1, and the $N-P+1^{th}$ and subsequent pulse signals of the reference driving signal and an auxiliary pulse signal are supplied when P is equal to or greater than 2, whereby the discharging performance for a case where one ink droplet is discharged can be further improved.

BEST MODE FOR CARRYING OUT THE INVENTION

Embodiments of the present invention will now be described with reference to the drawings.

<Embodiment 1>

Figure 1:
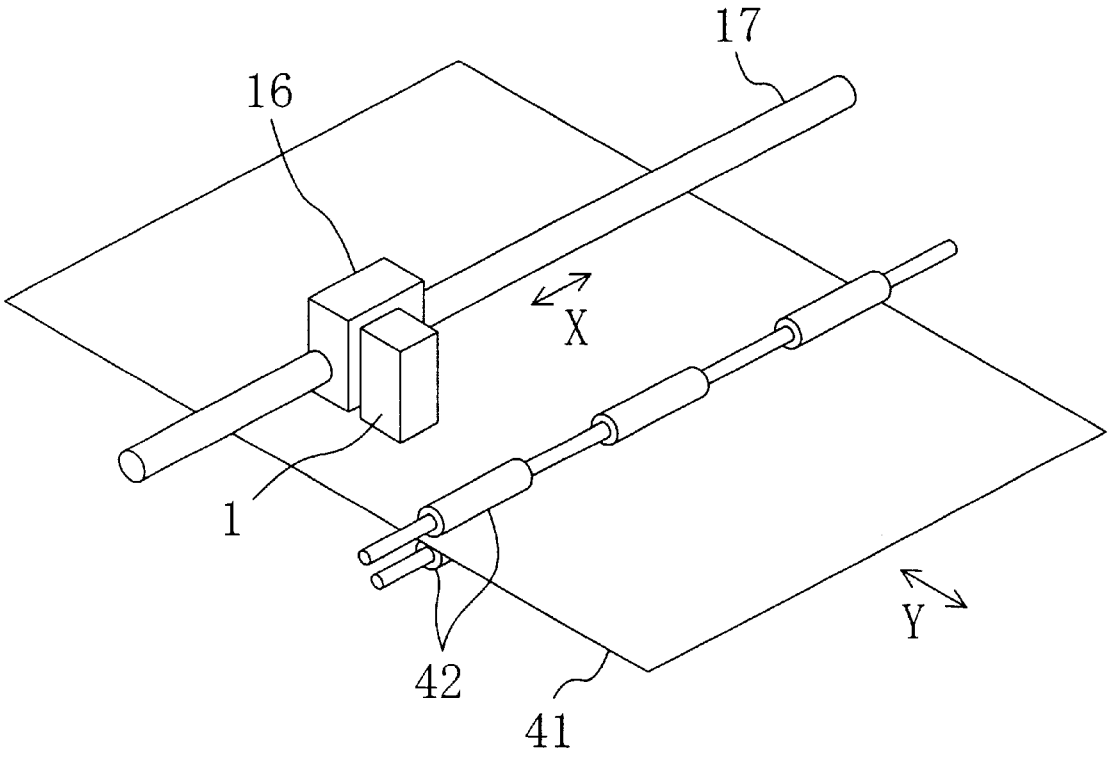
FIG. 1 is a diagram generally illustrating the configuration of an ink jet type recording apparatus according to one embodiment.
Figure 2:
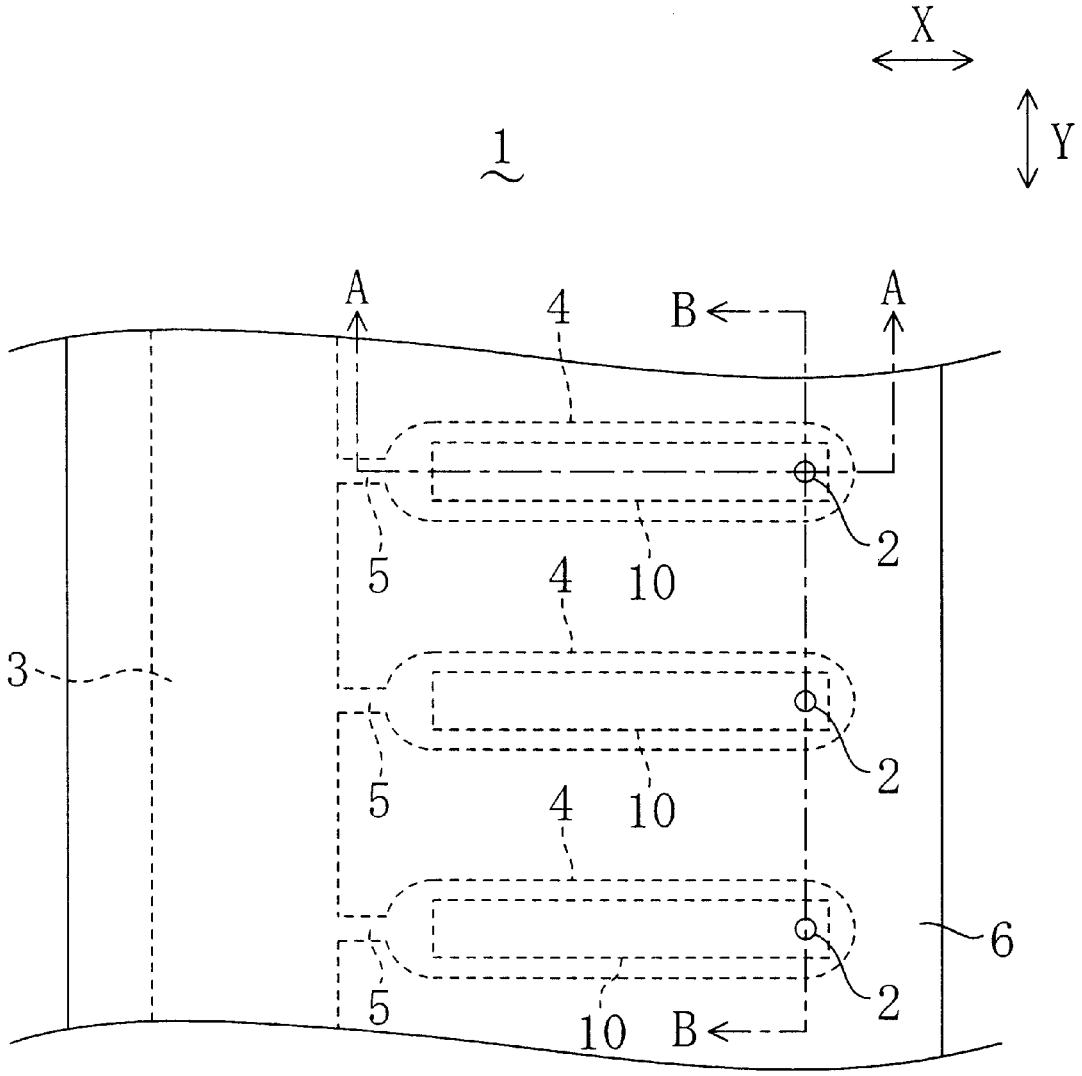
FIG. 2 is a plan view illustrating a part of an ink jet head.

FIG. 1 is a diagram generally illustrating the configuration of an ink jet type recording apparatus according to Embodiment 1. The ink jet type recording apparatus includes an ink jet head 1 which is supported and secured by a carriage 16. The carriage 16 is provided with a carriage motor 28 (see FIG. 6) which is not shown in FIG. 1. The ink jet head 1 and the carriage 16 are reciprocated by the carriage motor 28 in the primary scanning direction (the X direction as shown in FIG. 1 and FIG. 2) while being guided by a carriage shaft 17 which extends in the primary scanning direction. Note that the carriage 16, the carriage shaft 17 and the carriage motor 28 together form relative movement means for relatively moving the ink jet head 1 and recording paper 41 with respect to each other.

The recording paper 41 is sandwiched between two carrier rollers 42 which are rotated by a carrier motor 26 (see FIG. 6) which is not shown in FIG. 1, and is carried by the carrier motor 26 and the carrier rollers 42 in the secondary scanning direction (the Y direction as shown in FIG. 1 and FIG. 2) which is perpendicular to the primary scanning direction.

As illustrated in FIG. 2 to FIG. 5, the ink jet head 1 includes: a head body 40 which is provided with a plurality of pressure chambers 4 containing ink and a plurality of nozzles 2 communicated to the pressure chambers 4, respectively; and a plurality of actuators 10 for applying a pressure on the ink in the respective pressure chambers 4 so as to discharge ink droplets from the respective nozzles 2. The actuators 10 use a so-called flexural vibration type piezoelectric element 13, as will be described later, and are configured so as to discharge ink droplets through the nozzles 2 and fill the ink into the pressure chambers 4 by the change of the pressure in the pressure chambers 4 caused by contraction and expansion of the pressure chambers 4.

As illustrated in FIG. 2, the pressure chambers 4 are each formed in an elongate groove shape so as to extend in the primary scanning direction in the ink jet head 1, and are arranged with respect to each other with a predetermined interval in the secondary scanning direction. The nozzle 2 is provided on one end (the right end in FIG. 2) of each pressure chamber 4. The nozzles 2 provide openings on the lower surface of the ink jet head 1 which are arranged with respect to each other with a predetermined interval in the secondary scanning direction. One end of each ink supply path 5 is connected to the other end (the left end in FIG. 2) of the pressure chamber 4, and the other end of each ink supply path 5 is connected to an ink supply chamber 3 which is provided so as to extend in the secondary scanning direction Y.

Figure 3:
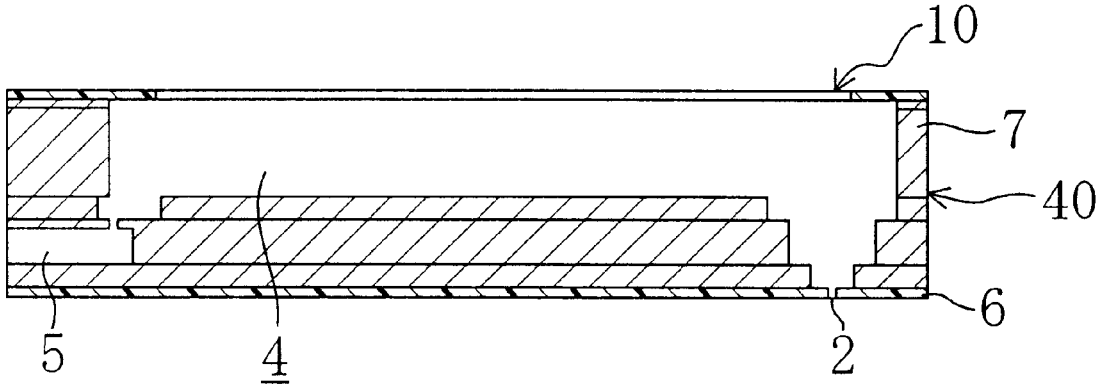
FIG. 3 is a cross-sectional view taken along line A—A of FIG. 2.

As illustrated in FIG. 3, the ink jet head 1 includes a nozzle plate 6 in which the nozzle 2 is formed, a partition wall 7 for partitioning and defining the pressure chamber 4 and the ink supply path 5 for each other, and the actuator 10, which are deposited in this order. The nozzle plate 6 is made of a polyimide plate having a thickness of 20 $\mu$m, and the partition wall 7 is made of a stainless laminate plate having a thickness of 280 $\mu$m.

Figure 4:
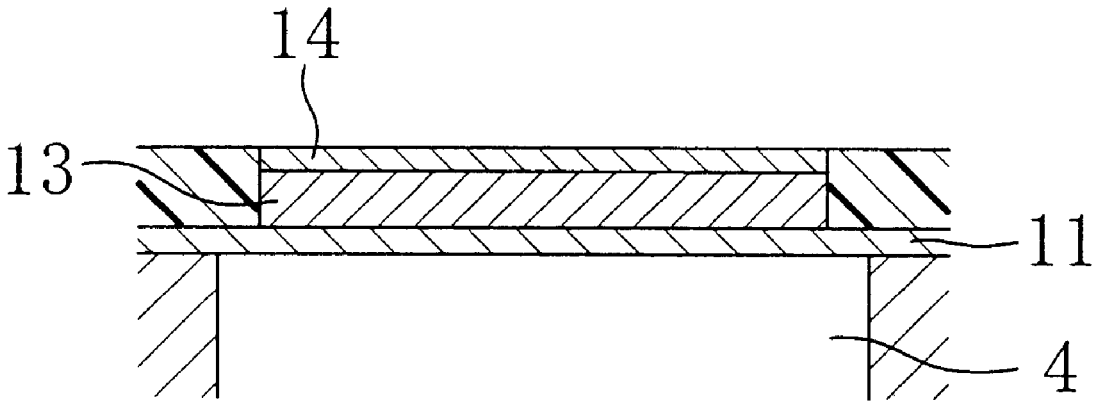
FIG. 4 is a cross-sectional view illustrating a part around an actuator.
Figure 5:
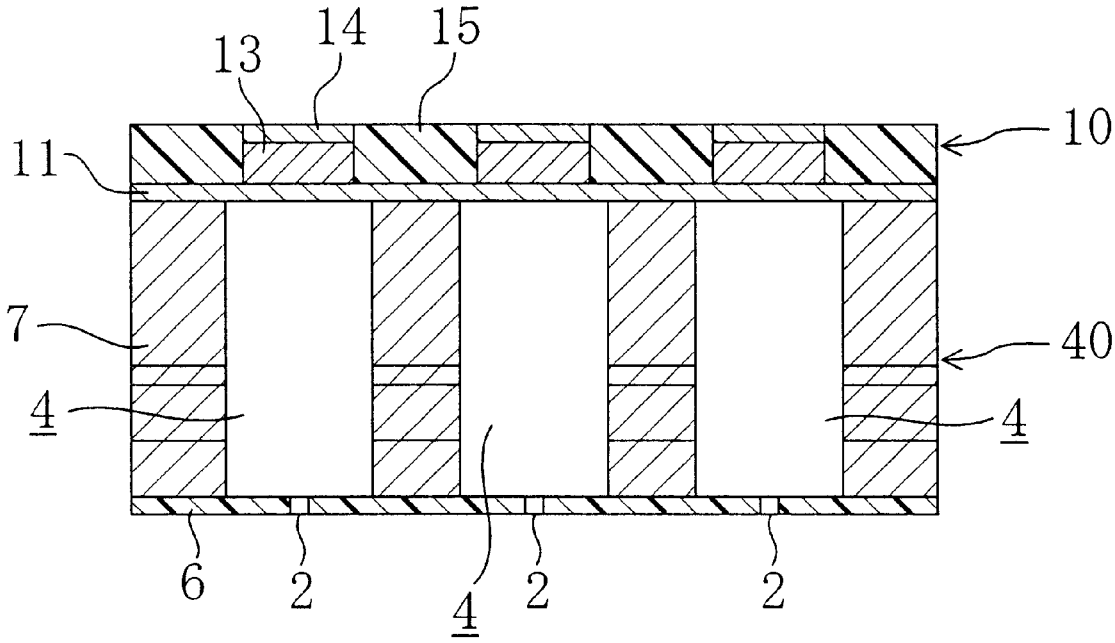
FIG. 5 is a cross-sectional view taken along line B—B of FIG. 2.

As illustrated in FIG. 4 and FIG. 5 in an exaggerated manner, the actuator 10 includes a vibration plate 11 provided so as to face the pressure chamber 4, the thin film piezoelectric element 13 for vibrating the vibration plate 11, and a separate electrode 14, which are deposited in this order. The vibration plate 11 is made of a chromium plate having a thickness of 2 $\mu$m, and also functions as a common electrode which, together with the separate electrode 14, applies a voltage across the piezoelectric element 13. The piezoelectric element 13 is provided for each pressure chamber 4, and a super thin piezoelectric element made of PZT (lead zirconate titanate) having a thickness of 3 $\mu$m can be suitably used. The separate electrode 14 is made of a platinum plate having a thickness of 0.1 $\mu$m, and the total thickness of the actuators 10 is about 5 $\mu$m. Note that an electrically insulative layer 15 made of polyimide is embedded between adjacent piezoelectric elements 13 and between adjacent separate electrodes 14.

Figure 6:
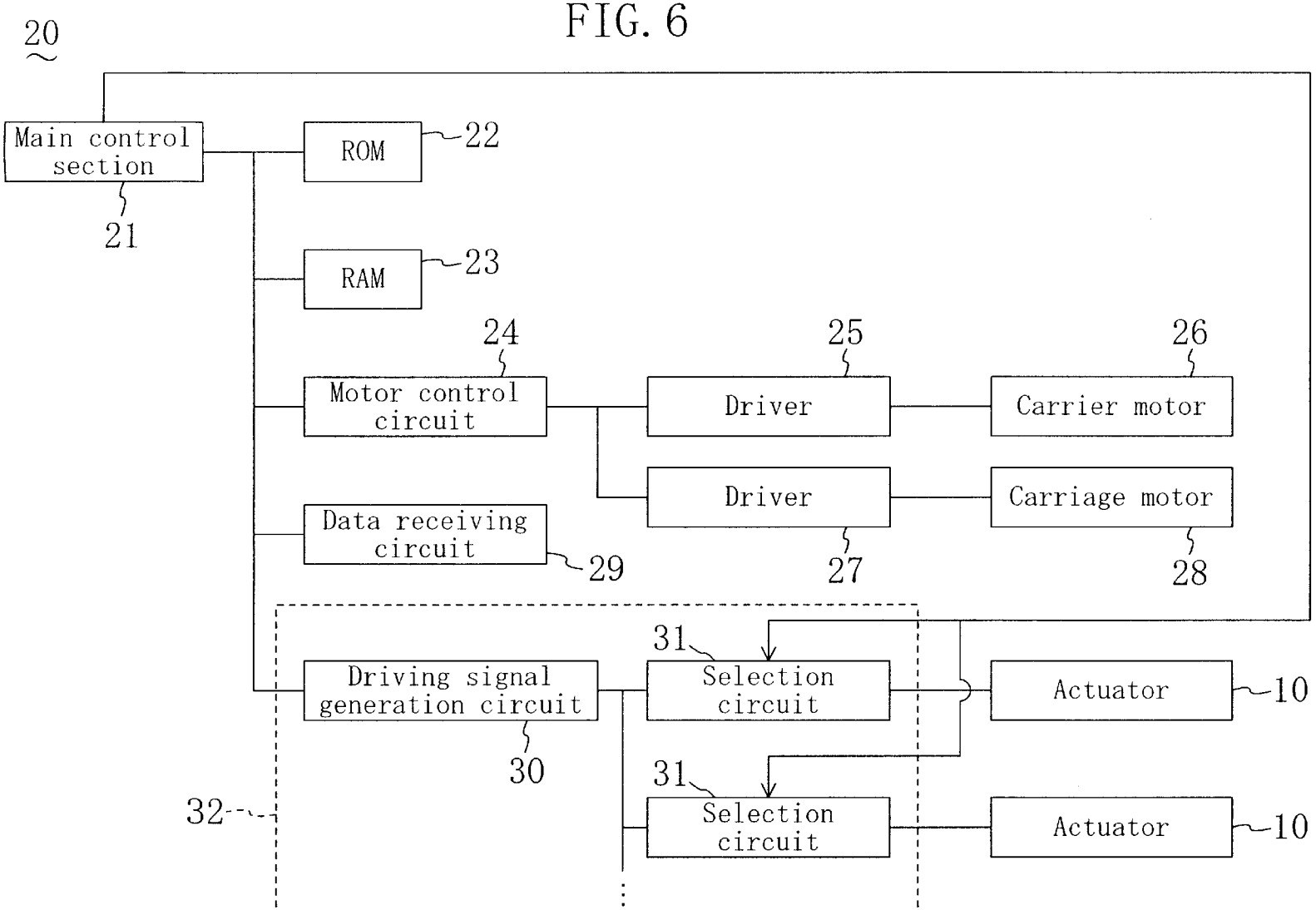
FIG. 6 is a block diagram illustrating a control circuit.

Next, a control circuit 20 of the ink jet type recording apparatus will be described referring to the block diagram of FIG. 6. The control circuit 20 includes a main control section 21 comprised of a CPU, a ROM 22 storing routines for various data processing operations, etc., a RAM 23 for storing various data, etc., driver circuits 25 and 27 and a motor control circuit 24 for driving/controlling the carrier motor 26 and the carriage motor 28, respectively, a data receiving circuit 29 for receiving print data, a driving signal generation circuit 30, and selection circuits 31. The actuators 10 are connected to the respective selection circuits 31. The driving signal generation circuit 30 generates a driving signal having a plurality of driving pulses during one printing cycle. The selection circuit 31 causes one or more driving pulses included in the driving signal to be selectively input to the actuator 10 while the ink jet head 1 is moving in the primary scanning direction along with the carriage 16. The driving signal generation circuit 30 and the selection circuits 31 together form driving signal supply means 32 for supplying a predetermined driving signal to each actuator 10.

Next, the operation of the ink jet type recording apparatus will be described. First, as the data receiving circuit 29 receives image data, the main control section 21 controls the carrier motor 26 and the carriage motor 28 via the motor control circuit 24 and the driver circuits 25 and 27, respectively, and causes the driving signal generation circuit 30 to generate a driving signal including a plurality of driving pulses, based on a processing routine stored in the ROM 22. Moreover, the main control section 21 outputs, to the selection circuit 31, information indicating which driving pulse(s) should be selected based on the image data. Then, based on the information, the selection circuit 31 selects predetermined one or more of the plurality of driving pulses and supplies the selected driving pulse(s) to the actuator 10. In this way, one or more ink droplets are discharged through the nozzles 2 of the ink jet head 1 during one printing cycle.

Figures 7A, 7B:
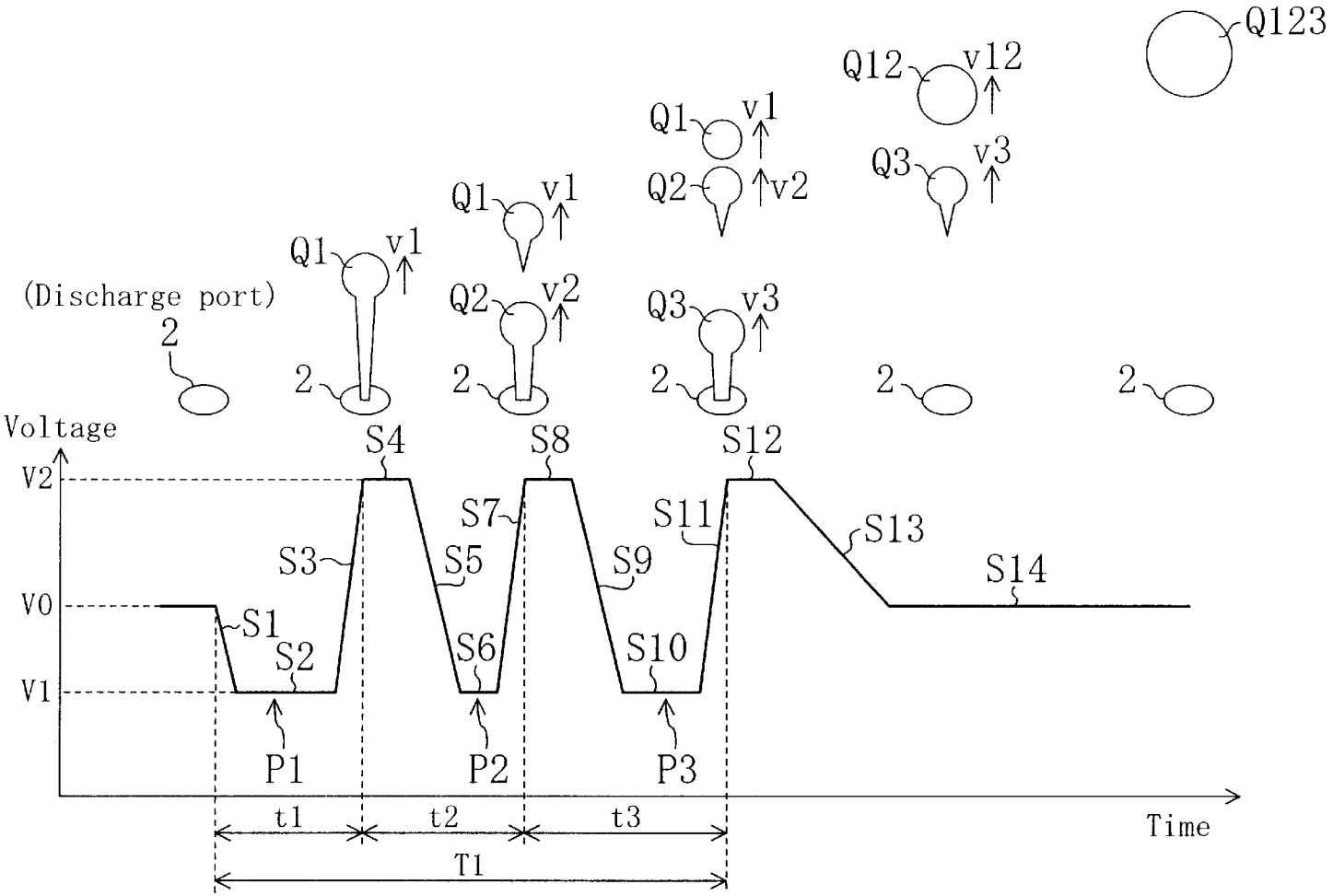
FIG. 7(*a*) is a schematic diagram illustrating the behavior of ink droplets being discharged, and FIG. 7(*b*) is a waveform diagram illustrating a driving signal according to Embodiment 1.
Figure 8:
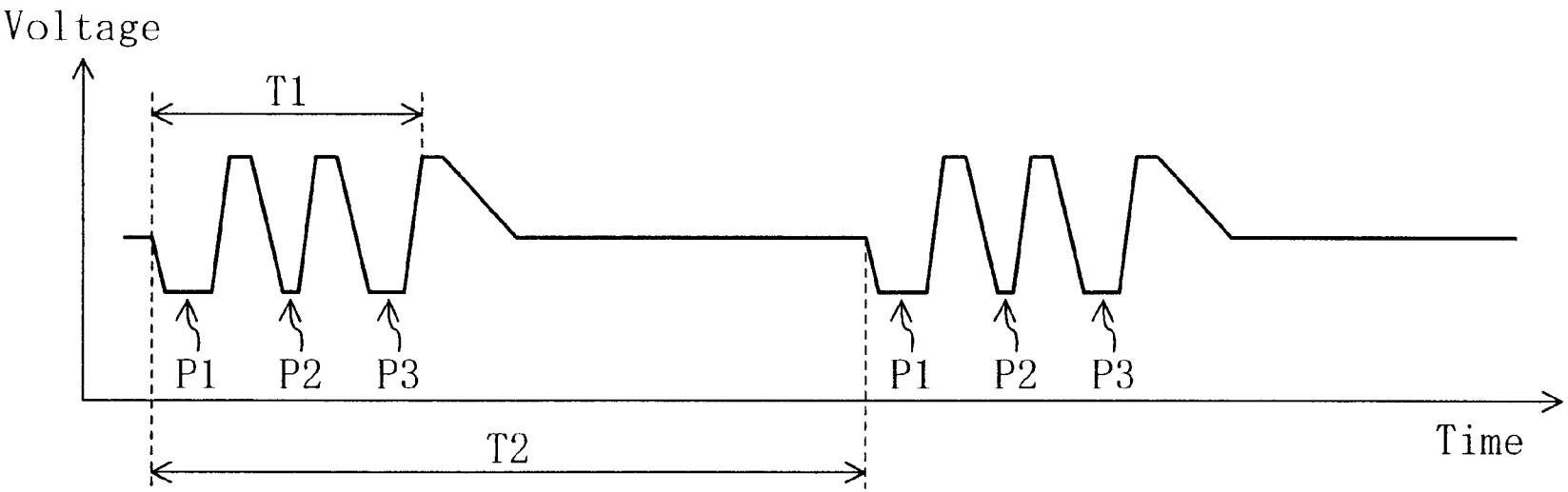
FIG. 8 is a waveform diagram illustrating a driving signal according to Embodiment 1.

Next, as an example, a driving signal used when discharging three ink droplets from the nozzle 2 during one printing cycle and the behavior of the ink droplets will be described referring to FIG. 7 and FIG. 8. As illustrated in FIG. 7, the driving signal includes three trapezoidal wave pulses P1 to P3, i.e., the initial pulse P1, the first subsequent pulse P2 and the second subsequent pulse P3, in one printing cycle T2. Each of the pulses P1 to P3 is a signal for driving the actuator 10 so as to once depressurize and then pressurize the pressure chamber 4. In other words, each of the pulses P1 to P3 is a signal for causing the actuator 10 to perform a pull and push operation (so-called pull-push operation) so as to discharge an ink droplet.

The initial pulse P1 is composed of a potential decreasing waveform S1 which decreases from a reference potential V0 to a minimum potential V1 for driving the actuator 10 to depressurize the pressure chamber 4, a minimum potential holding waveform S2 which holds the minimum potential V1, and a potential increasing waveform S3 which increases from the minimum potential V1 to a maximum potential V2 for driving the actuator 10 to pressurize the pressure chamber 4. The first subsequent pulse P2 is composed of a maximum potential holding waveform S4 which holds the maximum potential V2, a potential decreasing waveform S5 which decreases from the maximum potential V2 to the minimum potential V1, a minimum potential holding waveform S6 which holds the minimum potential V1, and a potential increasing waveform S7 which increases from the minimum potential V1 to the maximum potential V2. The second subsequent pulse P3 is composed of a maximum potential holding waveform S8 which holds the maximum potential V2, a potential decreasing waveform S9 which decreases from the maximum potential V2 to the minimum potential V1, a minimum potential holding waveform S10 which holds the minimum potential V1, and a potential increasing waveform S11 which increases from the minimum potential V1 to the maximum potential V2. The second subsequent pulse P3 is followed by a maximum potential holding waveform S12 which holds the maximum potential V2, a potential decreasing waveform S13 which decreases from the maximum potential V2 to the reference potential V0, and a reference potential holding waveform S14 which holds the reference potential V0. Note that the reference potential V0, the minimum potential V1 and the maximum potential V2 are preferably potentials in the range of about −100 V to 100 V. For example, the minimum potential V1, the reference potential V0 and the maximum potential V2 may be 0 V, 20 V and 50 V, respectively.

The driving pulses included in this driving signal have gradually increasing lengths so that the time interval between the pulses gradually approaches the natural period of the actuator 10. Note that the natural period as used herein refers to the natural period of the entire vibration system including even the influence of the ink in the pressure chamber 4, and is represented by the inverse of the Helmholtz natural vibration frequency f which is described in, for example, the specification of U.S. Pat. No. 4,697,193. Specifically, a first time t1 from the start of potential decrease in the potential decreasing waveform S1 to the end of potential increase in the potential increasing waveform S3 in the initial pulse P1, a second time t2 from the start of potential retention in the maximum potential holding waveform S4 to the end of potential increase in the potential increasing waveform S7 in the first subsequent pulse P2, and a third time t3 from the start of potential retention in the maximum potential holding waveform S8 to the end of potential increase in the potential increasing waveform S11 in the second subsequent pulse P3, are set to satisfy $t1 \leqq t2 < t3 \leqq t0$ with respect to a natural period t0 of the actuator 10. For example, when the natural period of the actuator 10 is 8 μs, t1, t2 and t3 may be set to be 5.5 μs, 7 μs and 8 μs, respectively.

The pulse width of each of the pulses P1 to P3 is set to be less than or equal to the natural period of the actuator 10. Moreover, typically with the thin film piezoelectric element 13 which has a long natural period, the time (peak hold time) for which to hold the maximum potential or the minimum potential of the pulse has a small influence on the ink droplet discharge velocity. Therefore, it is possible to reduce the peak hold time so as to relatively increase the falling time of the potential decreasing waveform and the rising time of the potential increasing waveform of the pulses P1 to P3. In the present embodiment, the potential holding time (peak hold time) of each of the potential holding waveforms S2, S4, S6, S8, S10 and S12 of the pulses P1 to P3 is set to be less than or equal to ¼ of the natural period of the actuator 10.

Moreover, the waveforms S12 to S14 after the second subsequent pulse is supplied are set to have sufficient durations to sufficiently settle down the ink in the pressure chamber 4 and the nozzle 2 during a period from the end of ink discharge in one printing cycle to the start of ink discharge in the next printing cycle. Specifically, a time T1 from the start of potential decrease in the potential decreasing waveform S1 of the initial pulse P1 to the end of potential increase in the potential increasing waveform S11 of the second subsequent pulse P3 is set to be less than or equal to one half of a minimum printing cycle T2. Thus, $T1/T2 \leqq 0.5$, and they may be set so that T1=20.5 μs and T2=50 μs, for example. The time T1 may be set within a range such that the ink can be discharged in a desirable manner, and it is particularly preferred to set the time T1 to be equal to or greater than the natural period or equal to or greater than (T2)/8 (i.e., $\frac{1}{8} \leqq T1/T2$).

As described above, in the present embodiment, the time interval t1, t2, t3 between pulses gradually approaches the natural period of the actuator 10. Therefore, as illustrated in FIG. 7(*a*), a first ink droplet Q1 discharged by the initial pulse P1, a second ink droplet Q2 discharged by the first subsequent pulse P2 and a third ink droplet Q3 discharged by the second subsequent pulse P3 are discharged so that they have gradually increasing speeds. In other words, $v1 \leqq v2 < v3$, where v1, v2 and v3 denote the discharge velocities of the first ink droplet Q1, the second ink droplet Q2 and the third ink droplet Q3, respectively. Note that the discharge velocity v3 of the third ink droplet Q3 may be set to be higher than a discharge velocity v12 of a first merged ink droplet Q12 so that the third ink droplet Q3 further merges the first merged ink droplet Q12 after the first ink droplet Q1 and the second ink droplet Q2 merge into the first merged ink droplet Q12. Alternatively, for example, they may be set to satisfy $v1=v2$ so that the third ink droplet Q3 and the second ink droplet Q2 merge into a second merged ink droplet, after which the second merged ink droplet further merges the first ink droplet Q1. In this way, the first, second and third ink droplets Q1 to Q3 merge in flight into a single ink droplet Q123, which strikes the recording paper 41 to form a single dot.

As described above, according to the present embodiment, the time intervals t1 to t3 of the pulses P1 to P3 are set to vary so as to gradually approach the natural period of the actuator 10, whereby it is possible to discharge a plurality of ink droplets so that the discharge velocity gradually increases. Therefore, it is possible to merge the first to third ink droplets Q1 to Q3 before striking, whereby it is possible to form a desirable ink dot on the recording paper 41 even when the carriage speed of the ink jet head 1 is high. Therefore, it is possible to perform multiple gray level recording at a high speed.

Moreover, since the time intervals t1 to t3 of the pulses P1 to P3 have gradually increasing lengths, it is possible to reduce the total time interval $T1=t1+t2+t3$, as compared to a case where the time intervals have gradually decreasing lengths toward the natural period of the actuator 10. Therefore, the printing speed is improved.

Moreover, since the peak hold time of each of the pulses P1 to P3 is short, it is possible to accordingly increase the potential falling time and/or the potential rising time, whereby it is possible to sufficiently ensure the potential rising time and the potential falling time. Therefore, it is possible to discharge stable ink droplets without extra dots, and to obtain desirable printing.

Moreover, since there is a long time from the second subsequent pulse P3, which is the last pulse in one printing cycle, to the initial pulse P1 of the next printing cycle, the pulsation and/or the meniscus vibration of the ink in the pressure chamber 4 and the nozzle 2 after discharging the third ink droplet Q3 are sufficiently reduced before the first ink droplet Q1 of the next printing cycle is discharged. Therefore, when the first ink droplet Q1 is discharged, the ink in the pressure chamber 4 and the nozzle 2 is sufficiently settled down. Thus, it is possible to stably discharge the first ink droplet Q1.

Figure 9:
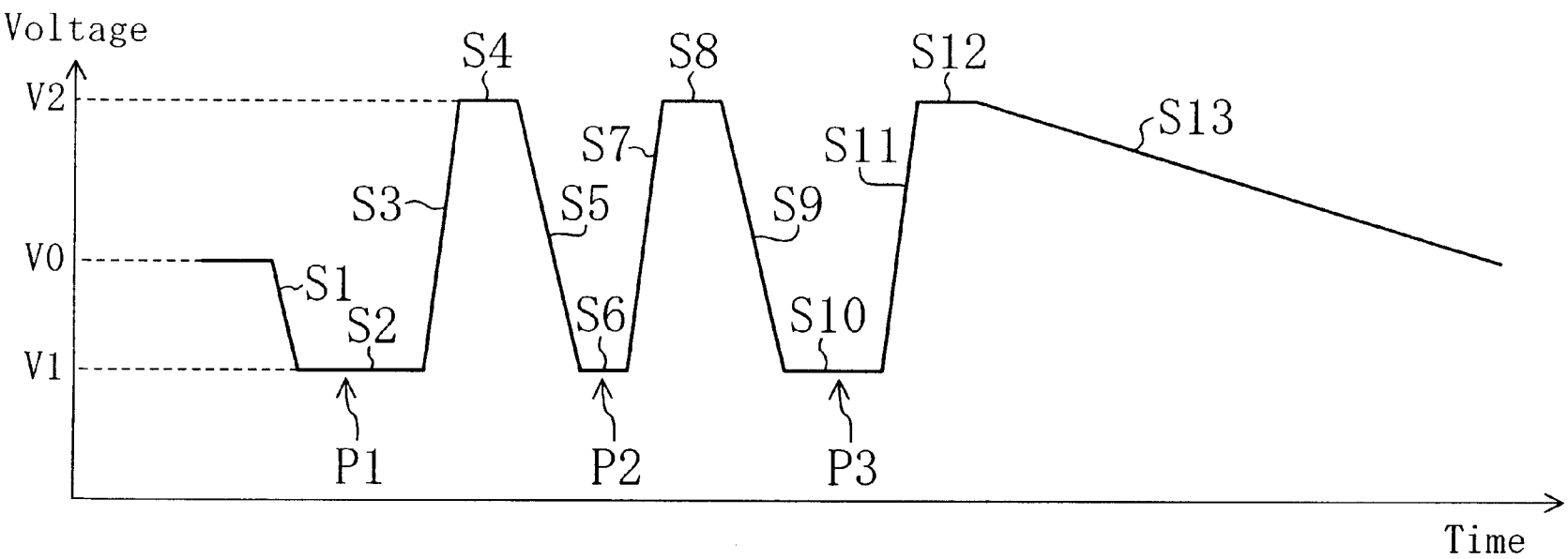
FIG. 9 is a waveform diagram illustrating a variation of a driving signal.

Note that in order to suppress the vibration of the actuator 10 to further settle down the ink, the inclination of the potential decreasing waveform S13 after the second subsequent pulse P3 may be reduced, as illustrated in FIG. 9, and the potential decreasing waveform S13 may be continuous with the potential decreasing waveform S1 of the initial pulse of the next printing cycle.

<Embodiment 2>

In Embodiment 2, a plurality of rectangular pulses are supplied to the actuator 10 in one printing cycle.

Figure 10:
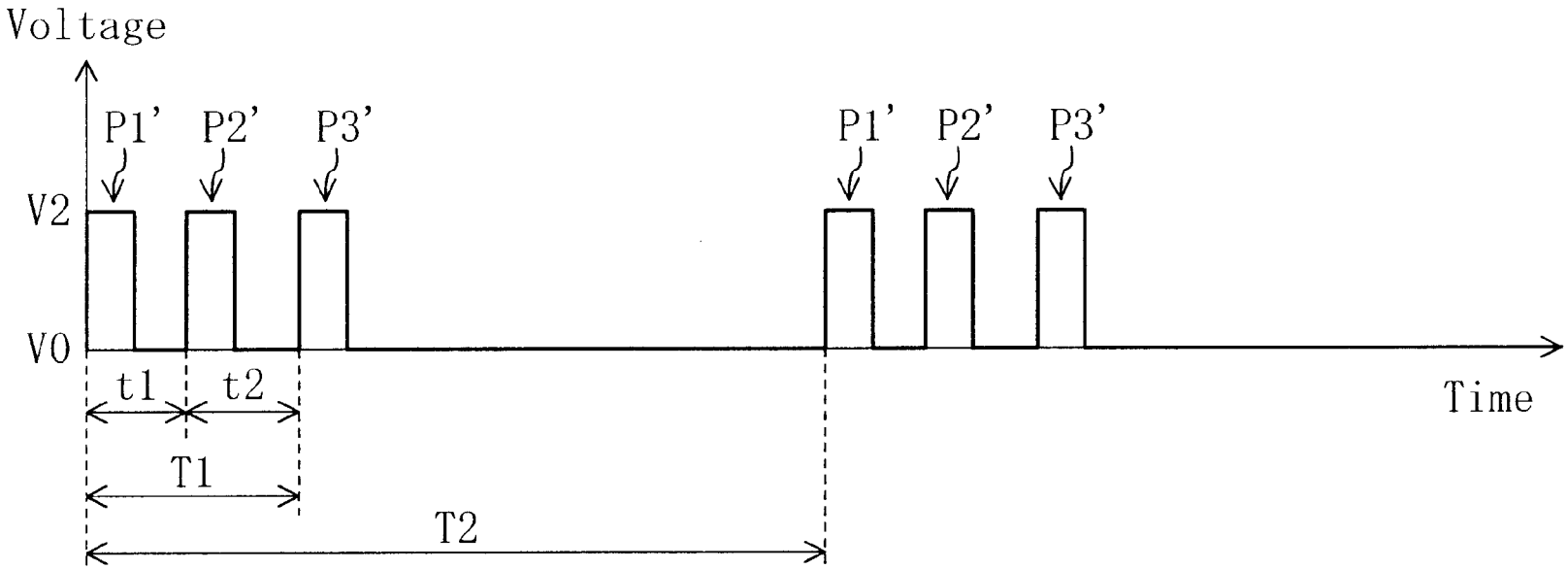
FIG. 10 is a waveform diagram illustrating a driving signal according to Embodiment 2.

As illustrated in FIG. 10, a group of driving pulses according to the present embodiment includes first to third rectangular pulses P1' to P3' in one printing cycle. While the waveforms of the first to third pulses P1' to P3' may differ from one another (in height and width), the first to third pulses P1' to P3' are rectangular pulses of the same waveform in the present embodiment. In other words, the first to third pulses P1' to P3' have the same pulse height and the same pulse width. The reference potential V0 and the maximum potential V2 are preferably potentials in the range of about −100 V to 100 V. For example, the reference potential V0 and the maximum potential V2 may be 0 V and 50 V, respectively. By setting the reference potential V0 and the maximum potential V2 as described above, it is no longer necessary to previously produce a driving signal in the driving signal generation circuit 30, and it is possible to produce driving pulses only by turning ON/OFF the selection circuit 31 between the reference potential V0 and the maximum potential V2. Thus, the driving pulses can be produced only by a switching (ON/OFF) operation of the selection circuit 31. Therefore, it is possible to omit the driving signal generation circuit 30, thereby simplifying the configuration of the control circuit 20.

The first time t1 from the end of potential increase in the first pulse P1' to the end of potential increase in the second pulse P2', and the second time t2 from the end of potential increase in the second pulse P2' to the end of potential increase in the third pulse P3', are set to satisfy $t1<t2 \leqq t0$ with respect to the natural period t0 of the actuator 10. Therefore, as in Embodiment 1, it is possible to discharge the first to third ink droplets Q1 to Q3 so that the discharge velocity thereof gradually increases and thus to merge the ink droplets Q1 to Q3 before striking the recording paper 41.

The time T1 between the start of potential increase in the first pulse P1' and the start of potential increase in the third pulse P3' is set to satisfy $T1/T2 \leqq 0.5$ with respect to the printing cycle T2. Therefore, as in Embodiment 1, the ink in the pressure chamber 4 and the nozzle 2 is sufficiently settled down when the next first ink droplet Q1 is discharged, whereby it is possible to stably discharge the first ink droplet Q1.

Furthermore, according to the present embodiment, the group of driving pulses is composed only of rectangular pulses, whereby it is possible to easily form the group of driving pulses. This is because rectangular pulses can be formed more easily than trapezoidal wave pulses. Therefore, it is possible to simplify the waveform of the driving signal. Moreover, since the rectangular pulses can be formed only by the ON/OFF operation of the selection circuit 31 as described above, it is possible to omit the driving signal generation circuit 30.

<Embodiment 3>

Now, depending on the viscosity of the ink, the volume of the pressure chamber 4, the rigidity of the actuator 10, the interval between driving pulses, etc., the influence of the vibration of the actuator 10 or the meniscus vibration of the ink from a preceding driving pulse may remain, thereby influencing the actuation of the actuator 10 by a subsequent driving pulse. The present inventors have discovered that when the influence of a preceding driving pulse is relatively large, the time interval between driving pulses which maximizes the ink droplet discharge velocity is actually slightly longer than the natural period. In other words, the time interval between driving pulses which maximizes the ink droplet discharge velocity may, in some cases, shift from the time equal to the natural period. Embodiment 3 is an improvement made on Embodiment 1 in view of such an influence of a preceding driving pulse.

Specifically, in the present embodiment, the first time t1, the second time t2 and the third time t3 are set to satisfy $t1 \leqq t2 < t0 < t3 \leqq tm$, where tm denotes the time interval which maximizes the ink droplet discharge velocity.

Note that the time interval tm is a time which depends on the viscosity of the ink, the rigidity of the actuator 10, and the like, and it can be determined by experiments, etc.

<Embodiment 4>

Figure 11:
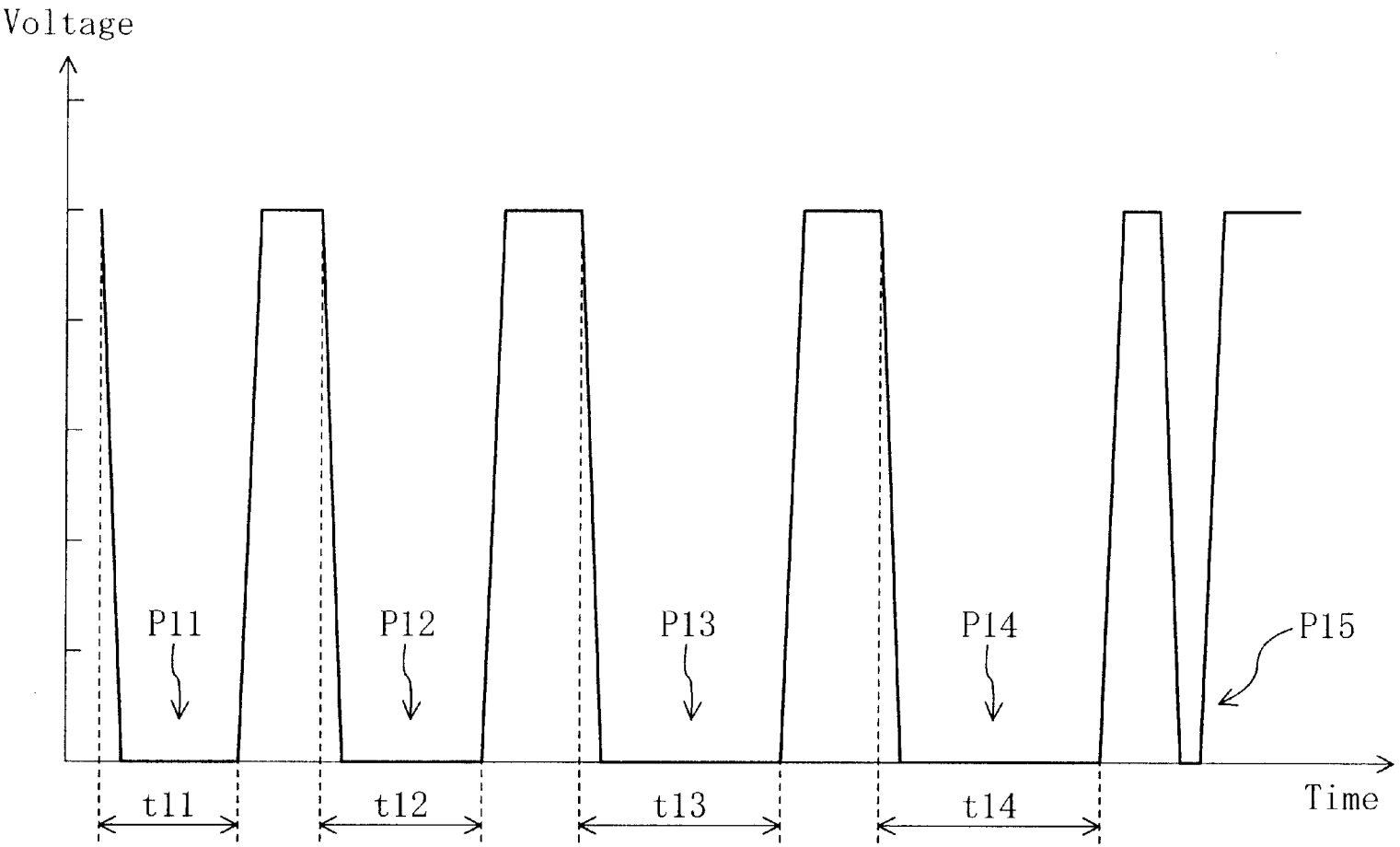
FIG. 11 is a waveform diagram illustrating a driving signal according to Embodiment 4.

In Embodiment 4, the pulse width of the driving pulse gradually approaches one half, or approximately one half, of the natural period t0 of the actuator 10. As illustrated in FIG. 11, the driving signal according to the present embodiment includes first to fourth pulses P11 to P14 and an auxiliary pulse P15 in one printing cycle. The first to fourth pulses P11 to P14 are driving pulses for discharging ink droplets. On the other hand, the auxiliary pulse P15 is not a driving pulse for discharging an ink droplet, but for suppressing the remaining vibration of the actuator and the meniscus vibration of the ink due to the first to fourth pulses P11 to P14 so that the damped vibration of the actuator 10 from the preceding printing cycle, or the like, does not influence the following printing cycle.

While the pulse width of each driving pulse may be defined by the time from the falling half maximum point to the rising half maximum point or by the time from the falling start point to the rising end point, the pulse width is set to the time from the falling start point to the rising start point. In the present embodiment, $0.5 \times t0 < tn$ and t11 to t14 are set to satisfy $t11 < t12 < t13 < t14 < tn$, where t11 denotes the pulse width of the first pulse P11, t12 denotes the pulse width of the second pulse P12, t13 denotes the pulse width of the third pulse P13, t14 denotes the pulse width of the fourth pulse P14, t0 denotes the natural period of the actuator 10, and tn denotes the pulse width which maximizes the ink discharge velocity. Note that while the time tn depends on the viscosity of the ink, the rigidity of the actuator 10, and the like, it is a time which can be determined by experiments, etc. For example, in a case where the natural period t0 of the actuator is 8 μs, t11, t12, t13 and t14 can be set to be 3.5 μs, 4 μs, 4.5 μs and 5.5 μs, respectively. Note that in a case where the influence of a preceding driving pulse on a subsequent driving pulse can be ignored, the pulse width which maximizes the ink droplet discharge velocity can be considered to coincide with one half of the natural period ($=0.5 \times t0$), whereby they may be set to satisfy $t11 < t12 < t13 < t14 < 0.5 \times t0$.

By supplying such a driving signal to the actuator 10, the first to fourth ink droplets are discharged with successively increasing discharge velocities, whereby they merge before striking the recording paper 41 so as to strike after merging into a single ink droplet.

Note that the driving pulse is not limited to a trapezoidal wave pulse, but may alternatively be a rectangular pulse as in Embodiment 2. Since rectangular pulses can be easily produced by the ON/OFF operation of the selection circuit 31, the driving signal generation circuit 30 can be omitted, thereby simplifying the configuration of the control circuit 20, as in Embodiment 2.

<Embodiment 5>

In the present embodiment, the driving signal generation circuit 30 (see FIG. 6) produces a reference driving signal having N (N is a natural number equal to or greater than 2) ink discharging pulse signals during one printing cycle, and an auxiliary pulse signal for suppressing the meniscus vibration of the ink. The selection circuit 31 causes one or more pulse signals included in the reference driving signal to be selectively input to the actuator 10 when the ink jet head 1 is moving in the primary scanning direction along with the carriage 16. Specifically, the selection circuit 31 is comprised of a switching circuit for turning ON/OFF the signal supply from the driving signal generation circuit 30 to the actuator 10, and supplies to the actuator 10 $N-P+1^{th}$ and subsequent pulse signals of the N ink discharging pulse signals included in the reference driving signal.

In the present embodiment, first, as the data receiving circuit 29 receives image data, the main control section 21 controls the carrier motor 26 and the carriage motor 28 via the motor control circuit 24 and the driver circuits 25 and 27, respectively, and the driving signal generation circuit 30 produces the reference driving signal, based on a processing routine stored in the ROM 22. Moreover, the main control section 21 outputs, to each selection circuit 31, information regarding the number of ink droplets that should be discharged during one printing cycle based on the image data. Then, based on the information, the selection circuit 31 selects P (P is a natural number less than or equal to N) pulse signals of the N pulse signals included in the reference driving signal and supplies the selected pulse signal(s) to the actuator 10. Moreover, the selection circuit 31 also supplies an auxiliary pulse signal from the driving signal generation circuit 30. In this way, one or more ink droplets are discharged through the nozzles 2 of the ink jet head 1 during one printing cycle.

Figure 12A:
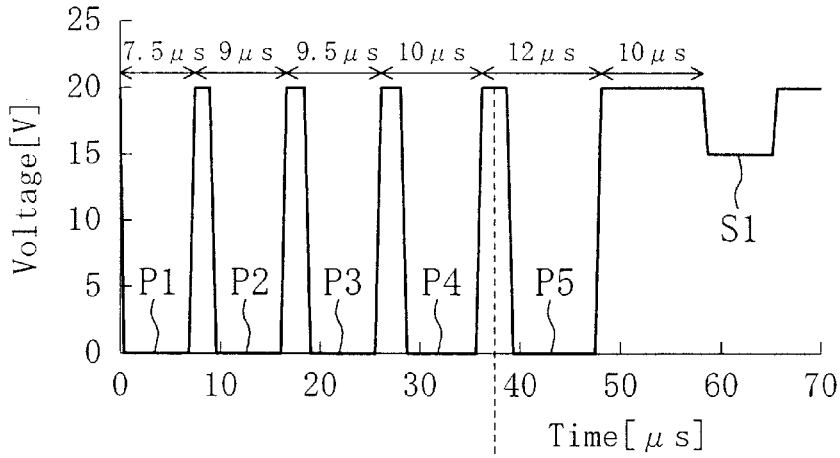
FIG. 12 illustrates timing diagrams in a case where the number of ink discharges is one in Embodiment 5, wherein (a) illustrates a driving signal which is produced by a driving signal generation circuit, (b) illustrates an ON/OFF signal of a selection circuit, and (c) illustrates a driving signal which is supplied to an actuator.
Figure 12B:
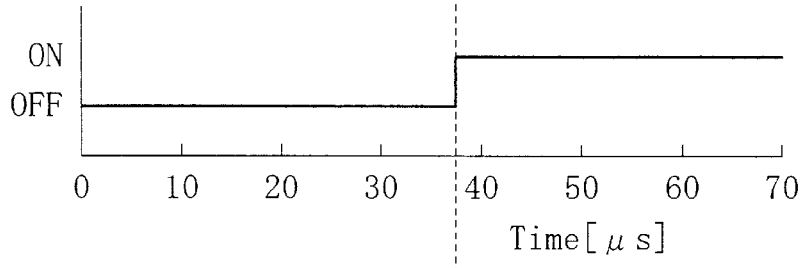
Figure 12C:
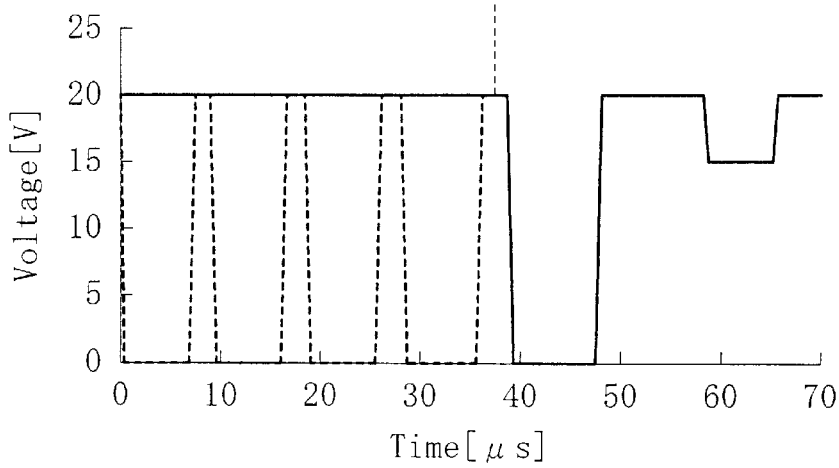

Next, as an example, an operation of discharging one ink droplet and another operation of discharging two ink droplets during one printing cycle will be described referring to FIG. 12 to FIG. 14.

First, referring to FIG. 12(*a*) or FIG. 13(*a*), the driving signal produced by the driving signal generation circuit 30 will be described. The driving signal generation circuit 30 produces a reference driving signal composed of five ink discharging pulse signals P1 to P5 and one auxiliary pulse signal S1 during one printing cycle. Each of the pulse signals P1 to P5 is composed of a potential decreasing waveform which decreases from a reference potential (20 V) to a negative pressure potential (0 V) for driving the actuator 10 to depressurize the pressure chamber 4, a negative pressure potential holding waveform which holds the negative pressure potential, and a potential increasing waveform which increases from the negative pressure potential to the reference potential. The auxiliary pulse signal S1 is composed of a potential decreasing waveform which decreases from the reference potential (20 V) to the auxiliary negative pressure potential (15 V), an auxiliary negative pressure potential holding waveform which holds the auxiliary negative pressure potential, and a potential increasing waveform which increases from the auxiliary negative pressure potential to the reference potential. Thus, the pulse signals P1 to P5 and S1 are signals for causing the actuator 10 to perform a pull and push operation (so-called pull-push operation). Note that while each of the pulse signals P1 to P5 and S1 has a rectangular waveform in this example, the signal waveform may be a trapezoidal wave.

The pulse signals P1 to P5 of the reference driving signal are formed so that the time interval between pulses gradually approaches the natural period of the actuator 10 and gradually increases so that a later discharged ink droplet has a higher discharge velocity than that of a previously discharged ink droplet. Specifically, the intervals of the pulse signals P1 to P5 are set to be 7.5 μs, 9 μs, 9.5 μs, 10 μs and 12 μs, respectively. Note that the natural period of the actuator 10 as used herein refers to the natural period of the entire vibration system including even the influence of the ink in the pressure chamber 4, and is 12 μs in this example.

Figure 14:
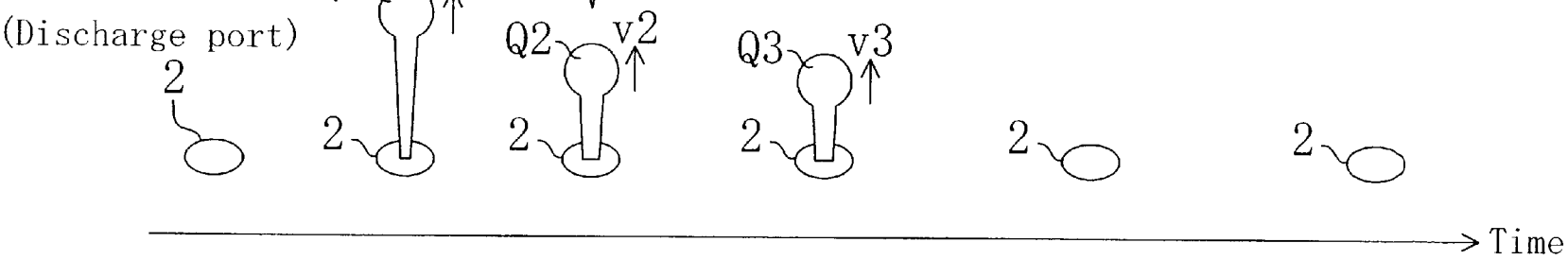
FIG. 14 is a schematic diagram illustrating the behavior of ink droplets being discharged.

Since the time intervals between pulse signals are set as described above, in a case where three ink droplets Q1, Q2 and Q3 are sequentially discharged as illustrated in FIG. 14, for example, the discharge velocities v1 to v3 of the ink droplets Q1 to Q3 satisfy v1<v2<v3. Then, the second ink droplet Q2 catches up with the first ink droplet Q1 before striking the recording paper, and the first ink droplet Q1 and the second ink droplet Q2 merge into an ink droplet Q12. Moreover, the third ink droplet Q3 catches up with the ink droplet Q12, and the third ink droplet Q3 and the ink droplet Q12 merge to form an ink droplet Q123. Thus, the sequentially discharged ink droplets Q1 to Q3 merge before striking the recording paper into a single ink droplet which forms a single ink dot on the recording paper.

The interval between the fifth pulse signal P5, which is the last pulse signal (the $N^{th}$ pulse signal) of the reference driving signal, and the auxiliary pulse signal S1 is set to be 0.5 to 1.5 times the natural period of the actuator 10. Note that it is particularly preferred that the interval is 0.5 to 1 times the natural period of the actuator 10, and is set to be 10 μs (about 0.83 times the natural period) in this example. The auxiliary negative pressure potential of the auxiliary pulse signal S1 is preferably 0.1 to 0.3 times the negative pressure potential of the pulse signals P1 to P5 of the reference driving signal, and is set to be 0.25 times the potential in this example.

Next, the operation of the selection circuit 31 will be described. In a case where the number of ink discharges is one, the selection circuit 31 is switched from the OFF state to the ON state while the potential of the reference driving signal is at the reference potential between the fourth pulse signal P4 and the fifth pulse signal P5, as illustrated in FIG. 12(*b*). Then, it is switched from the ON state to the OFF state while the potential is at the reference potential after the auxiliary pulse signal S1. By such an ON/OFF operation of the selection circuit 31, the fifth pulse signal P5 and the auxiliary pulse signal S1 are supplied to the actuator 10, as illustrated in FIG. 12(*c*).

Figure 13A:
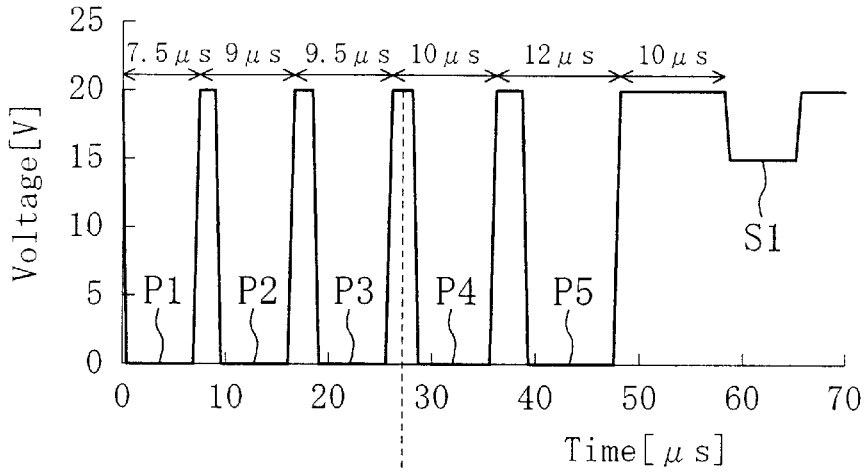
FIGS. 13(*a*)–(*c*) is similar to FIG. 12, but in a case where the number of ink discharges is two in Embodiment 5.
Figure 13B:
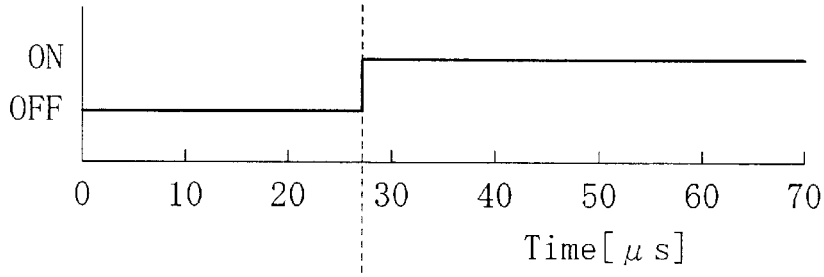
Figure 13C:
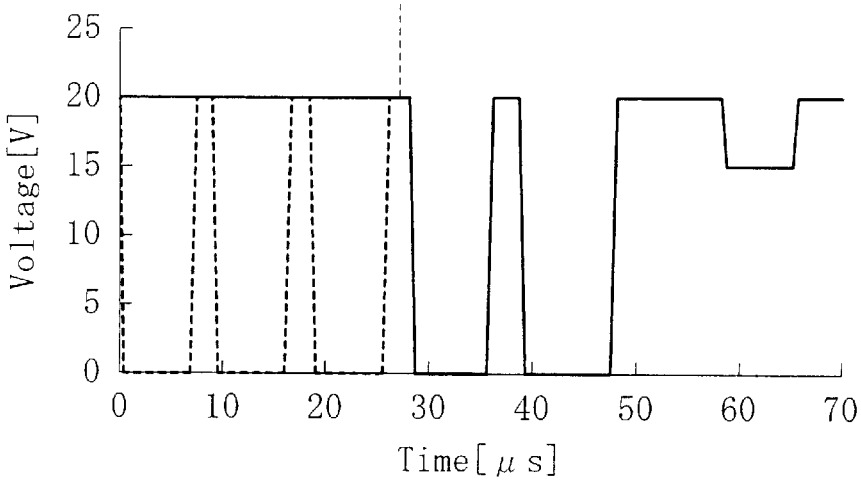

On the other hand, in a case where the number of ink discharges is two, the selection circuit 31 is switched from the OFF state to the ON state while the potential of the reference driving signal is at the reference potential between the third pulse signal P3 and the fourth pulse signal P4, as illustrated in FIG. 13(*b*). Then, as in the case where the number of ink discharges is one, it is switched from the ON state to the OFF state after the auxiliary pulse signal S1. By such an ON/OFF operation of the selection circuit 31, the fourth pulse signal P4, the fifth pulse signal P5 and the auxiliary pulse signal S1 are supplied to the actuator 10, as illustrated in FIG. 13(*c*).

As described above, according to the present embodiment, while the driving signal generation circuit 30 produces only one kind of reference driving signal, a part or whole of the reference driving signal is appropriately selected by the ON/OFF operation of the selection circuit 31, so as to supply to the actuator 10 a number of pulse signals according to the number of ink discharges. Thus, it is possible to simplify the driving signal generation circuit 30 and to provide the control circuit 20 in a simple and inexpensive manner.

The pulse signals of the reference driving signal are formed so that a later discharged ink droplet has a higher discharge velocity than that of a previously discharged ink droplet, and a number of pulse signals in a latter portion of the reference driving signal according to the number of ink discharges are selected by the selection circuit 31, whereby a plurality of ink droplets can be merged before striking, and the flying velocity of an ink droplet (the discharge velocity of an ink droplet where the number of ink discharges is one, and the flying velocity of a merged ink droplet where the number of ink discharges is two or more) can be kept substantially constant even when the number of ink discharges changes. Therefore, high-speed printing is enabled, while the printing quality is improved.

Since there are only two potentials, i.e., the reference potential and the negative pressure potential, for the holding waveforms of the reference driving signal, it is possible to desirably supply pulse signals to the actuator 10 only by switching the selection circuit 31 from the OFF state to the ON state while the potential is at the reference potential. In other words, since a reference potential holding waveform having a certain duration is provided between the pulse signals, desirable pulse signals are supplied to the actuator 10 even if the selection circuit 31 switching timing is somewhat shifted, as long as the selection circuit 31 is switched during the reference potential holding waveform. Therefore, the driving signal is stably supplied to the actuator 10, thereby improving the ink discharging performance.

<Embodiment 6>

Embodiment 6 adds changes in the reference driving signal and the auxiliary pulse signal produced by the driving is signal generation circuit 30 and the selection circuit 31 switching timing to those of Embodiment 5.

Figure 15A:
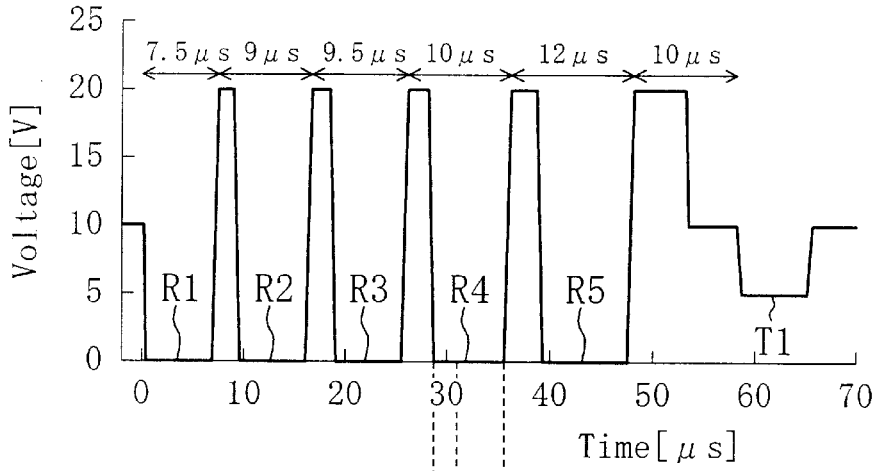
FIGS. 15(*a*)–(*c*) is similar to FIG. 12, but for Embodiment 6.
Figure 15B:
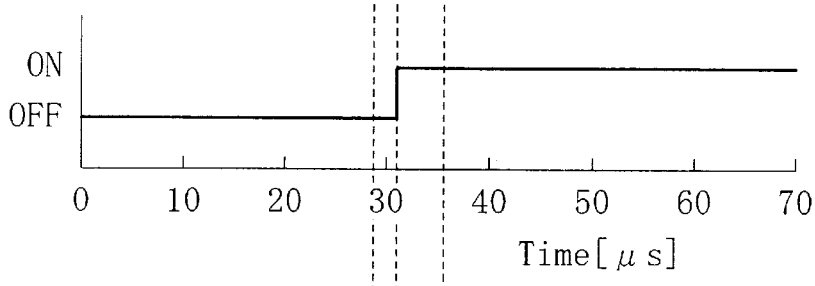
Figure 15C:
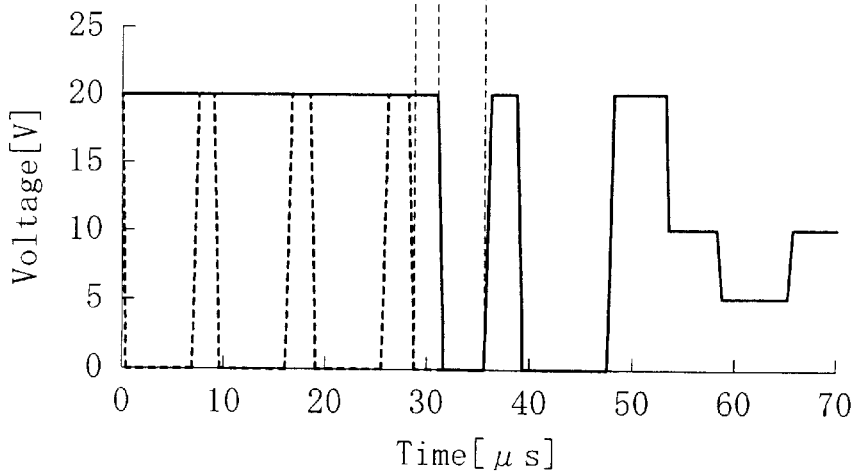

As illustrated in FIGS. 15(*a*)–(*c*), the reference driving signal of Embodiment 6 includes an initial pulse signal R1 and four subsequent pulse signals R2 to R5 following the initial pulse signal R1. The initial pulse signal R1 is composed of a potential decreasing waveform which decreases from a reference potential (10 V) to a negative pressure potential (0 V), a negative pressure potential holding waveform which holds the negative pressure potential, and a potential increasing waveform which increases from the negative pressure potential to a positive pressure potential (20 V). Each of the subsequent pulse signals R2 to R5 is composed of a potential decreasing waveform which decreases from the positive pressure potential to the negative pressure potential, a negative pressure potential holding waveform which holds the negative pressure potential, and a potential increasing waveform which increases from the negative pressure potential to the positive pressure potential. An auxiliary pulse signal T1 is composed of a potential decreasing waveform which decreases from the reference potential to the auxiliary negative pressure potential (5 V), an auxiliary negative pressure potential holding waveform which holds the auxiliary negative pressure potential, and a potential increasing waveform which increases from the auxiliary negative pressure potential to the reference potential.

As in Embodiment 5, the selection circuit 31 is configured so as to select a number of pulse signals in a latter portion of the reference driving signal according to the number of ink discharges. However, unlike Embodiment 5, the selection circuit 31 of Embodiment 6 is switched from the OFF state to the ON state after passage of a predetermined time from the start of waveform holding of the negative pressure potential holding waveform of a pulse signal. In other words, the selection circuit 31 is configured so as to be switched with a predetermined time delay from the potential decrease of a pulse signal.

With a control circuit which supplies the reference driving signal simultaneously with the completion of the potential decrease of a pulse signal, there is no problem when the switching timing is delayed, but if the switching timing is too early, a driving signal whose potential is still decreasing would be supplied, thereby making the operation of an actuator unstable. According to the present embodiment, however, the selection circuit 31 switching timing is set to be a predetermined time after when the potential has decreased to the negative pressure potential, whereby even if an error occurs in the switching timing, the selection circuit 31 is always switched while the potential is at the negative pressure potential. Therefore, the operation of an actuator is stable. Note that due to the time lag between when the potential has transitioned to the negative pressure potential and when the selection circuit 31 is switched, the pulse signal which is first supplied to the actuator 10 is a signal whose pulse width is smaller than those of the subsequently supplied pulse signals. However, since a later discharged ink droplet has a higher discharge velocity than that of the first ink droplet discharged, the flying behavior of the merged ink droplet is dominated primarily by the flying behavior of the later discharged ink droplet. Therefore, in the present embodiment, despite the delay in the selection circuit 31 switching timing, there is no problem in practice when discharging ink, and it is possible to realize a desirable ink discharging performance.

<Embodiment 7>

Figure 16A:
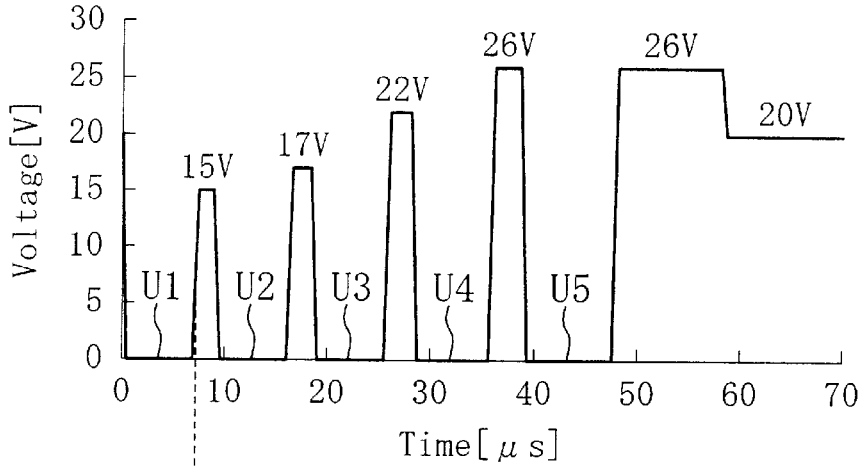
FIG. 16 is similar to FIG. 12, but in a case where the number of ink discharges is one in Embodiment 7.
Figure 16B:
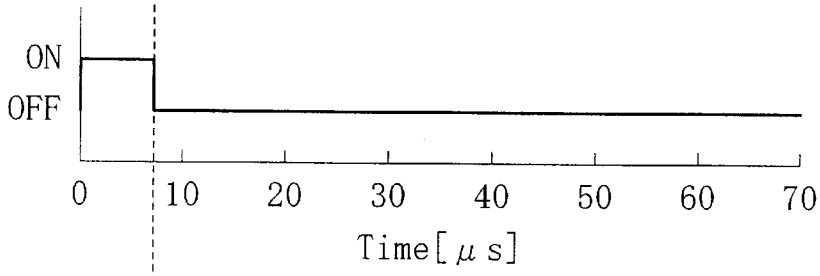
Figure 16C:
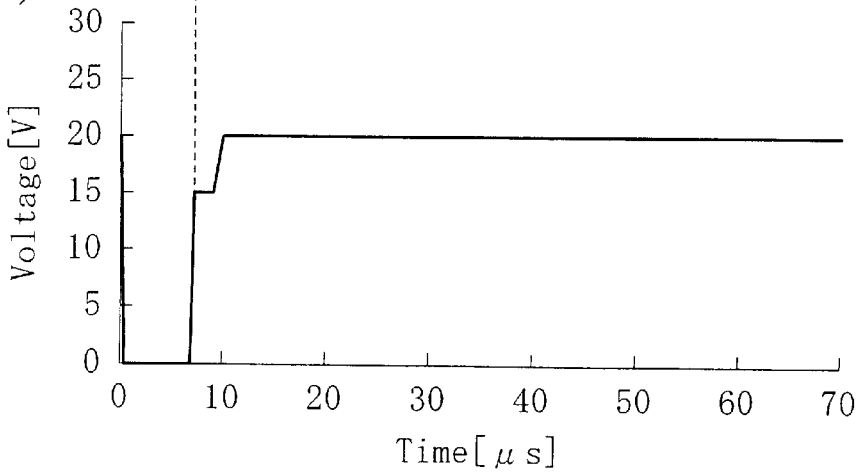
Figure 17A:
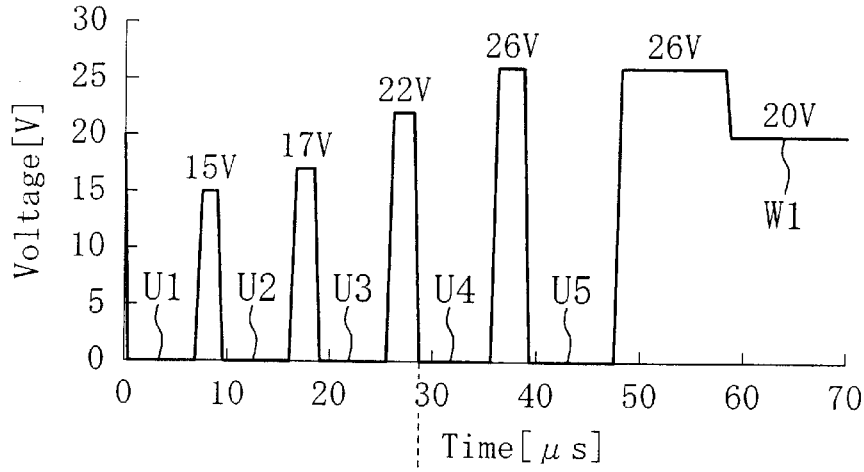
FIGS. 17(*a*)–(*c*) is similar to FIG. 12, but in a case where the number of ink discharges is two in Embodiment 7.
Figure 17B:
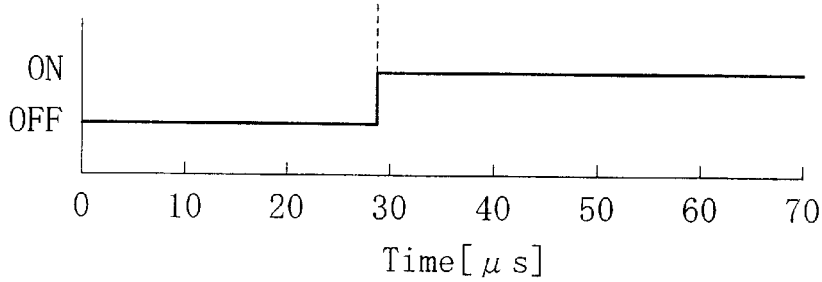
Figure 17C:
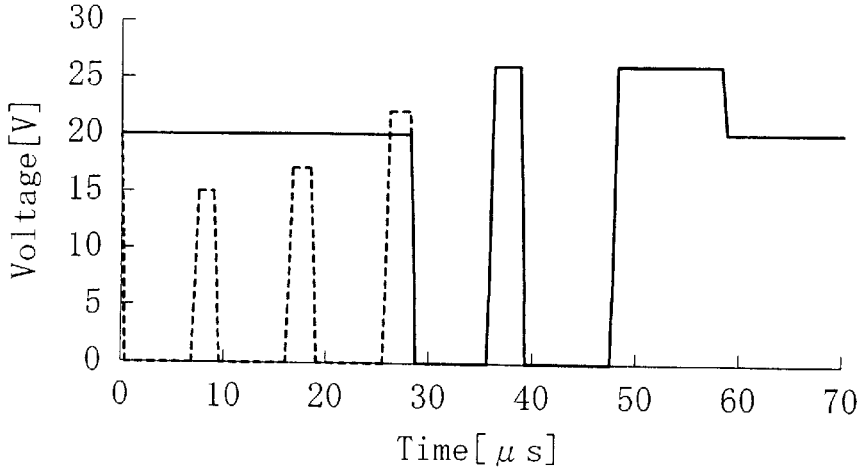

As illustrated in FIG. 16 and FIG. 17, Embodiment 7 also adds changes in the signals produced by the driving signal generation circuit 30 and the selection circuit 31 switching timing to those of Embodiment 5.

The reference driving signal of Embodiment 7 has an initial pulse signal U1 and four subsequent pulse signals U2 to U5 following the initial pulse signal U1. The initial pulse signal U1 is composed of a potential decreasing waveform which decreases from a reference potential (20 V) to a negative pressure potential (0 V), a negative pressure potential holding waveform which holds the negative pressure potential, and a potential increasing waveform which increases from the negative pressure potential to a predetermined positive pressure potential (15 V). Each of the subsequent pulse signals U2 to U5 is composed of a potential decreasing waveform which decreases from a respective positive pressure potential (15 V, 17 V, 22 V, 26 V) to the negative pressure potential (0 V), a negative pressure potential holding waveform which holds the negative pressure potential, and a potential increasing waveform which increases from the negative pressure potential to a respective positive pressure potential (17 V, 22 V, 26 V, 26 V). The subsequent pulse signals U2 to U5 are formed with gradually increasing potential differences (pulse heights) so that a later discharged ink droplet has a higher discharge velocity than that of a previously discharged ink droplet. Specifically, the potential difference of the initial pulse signal U1 is set to be 20 V for the purpose of improving the first ink droplet discharging performance, and the potential differences of the remaining subsequent pulse signals U2 to U5 are set to be 15 V, 17 V, 22 V and 26 V, respectively.

After the potential increasing waveform of the last subsequent pulse signal U5, there are provided an auxiliary potential decreasing waveform which decreases from the positive pressure potential (26 V) to the reference potential (20 V), and an auxiliary potential holding waveform which holds the reference potential thereafter. In the present embodiment, the auxiliary potential decreasing waveform and the auxiliary potential holding waveform together form an auxiliary pulse signal for suppressing the meniscus vibration of the ink. Note that the interval between the end of potential increase in the potential increasing waveform of the subsequent pulse signal U5 and the start of potential decrease in the auxiliary potential decreasing waveform in the auxiliary pulse signal is preferably set to 0.5 to 1 times the natural period of the actuator 10.

In the present embodiment, in a case where the number of ink droplets to be discharged is one, the selection circuit 31 selects the initial pulse signal U1, as illustrated in FIGS. 16(*b*) and (*c*). Thus, the selection circuit 31 is turned to the ON state simultaneously with the start of a printing cycle, and is turned to the OFF state during or after the potential increasing waveform of the initial pulse signal U1.

On the other hand, in a case where the number of ink droplets to be discharged is two or more, the selection circuit 31 selects a number of pulse signals in a latter portion of the reference driving signal according to the number of ink droplets to be discharged. In a case where the number of ink droplets to be discharged is two, the selection circuit 31 is switched from the OFF state to the ON state simultaneously with, or after passage of a predetermined time from, the end of potential decrease in the subsequent pulse signal U4, so as to supply the two pulse signals U4 and U5 to the actuator 10, as illustrated in FIGS. 17(*b*) and (*c*).

As described above, in the present embodiment, the initial pulse signal U1 is supplied in a case where one ink droplet is discharged during one printing cycle, and pulse signals in a latter portion of the reference driving signal are supplied in a case where two or more ink droplets are discharged during one printing cycle. Therefore, while the various effects as described above can be obtained when the number of ink droplets to be discharged is two or more, the precision of the discharge timing and the discharge stability can be further improved when the number of ink droplets to be discharged is one.

<Alternative Embodiments>

The ink discharging pulse signal of the reference driving signal is not limited to such a pulse signal which causes an actuator to perform a pull-push operation, but may alternatively be such a pulse signal which causes it to perform a so-called push-pull operation.

The auxiliary pulse signal is not limited to the auxiliary pulse signal of Embodiments 5 to 7 described above, and may alternatively be composed of other pulse signals. For example, it may be composed of a potential increasing waveform which increases from a reference potential to a positive pressure potential, a positive pressure potential holding waveform which holds the positive pressure potential, and a potential decreasing waveform which decreases from the positive pressure potential to the reference potential, so as to cause the actuator 10 to perform a so-called push-pull operation. In such a case, the interval between the end of potential increase in the potential increasing waveform in the last pulse signal of the reference driving signal and the start of potential increase in the potential increasing waveform of the auxiliary pulse signal is preferably set to be 1 to 1.5 times the natural period of the actuator 10.

INDUSTRIAL APPLICABILITY

As described above, the present invention is useful in a recording apparatus, etc., which performs an ink jet type recording operation, such as a printer, a facsimile, and a copier.

What is claimed is:

1. An ink jet head, comprising:

a head body which is provided with a pressure chamber containing ink and a nozzle communicated to the pressure chamber;

an actuator having a piezoelectric element for applying a pressure on the ink in the pressure chamber by a piezoelectric effect of the piezoelectric element; and driving signal supply means for supplying a driving voltage signal including a plurality of driving pulses to the piezoelectric element of the actuator, wherein the driving signal supply means supplies the plurality of driving pulses during one predetermined printing cycle so that a time interval between the driving pulses gradually approaches a natural period of the actuator.

2. The ink jet head of claim 1, wherein the driving signal supply means supplies the plurality of driving pulses so that the time interval between the driving pulses gradually increases.

3. The ink jet head of claim 2, wherein:

the driving voltage signal includes a negative pressure potential for driving the actuator to depressurize the pressure chamber, and a positive pressure potential for driving the actuator to pressurize the pressure chamber; and the plurality of driving pulses include:

an initial driving pulse composed of a potential decreasing waveform which decreases from a predetermined reference potential between a negative pressure potential and a positive pressure potential to the negative pressure potential, a negative pressure potential holding waveform which holds the negative pressure potential, and a potential increasing waveform which increases from the negative pressure potential to the positive pressure potential; and one or more subsequent driving pulses each composed of a positive pressure potential holding waveform which holds a positive pressure potential, a potential decreasing waveform which decreases from the positive pressure potential to a negative pressure potential, a negative pressure potential holding waveform which holds the negative pressure potential, and a potential increasing waveform which increases from the negative pressure potential to a positive pressure potential.

4. The ink jet head of claim 3, wherein:

the driving signal supply means is configured so as to sequentially supply at least the initial driving pulse, a first subsequent driving pulse and a second subsequent driving pulse during one printing cycle; and a first time t1 from a start of potential decrease in the potential decreasing waveform to an end of potential increase in the potential increasing waveform in the initial driving pulse, a second time t2 from a start of potential holding in a positive pressure potential holding waveform to an end of potential increase in a potential increasing waveform in the first subsequent driving pulse, and a third time t3 from a start of potential holding in a positive pressure potential holding waveform to an end of potential increase in a potential increasing waveform in the second subsequent driving pulse, are set to satisfy $$t1 \leqq t2 < t3 \leqq t0$$

with respect to the natural period t0 of the actuator.

5. The ink jet head of claim 3, wherein:

the positive pressure potential of the initial driving pulse and the positive pressure potential of each of the subsequent driving pulses are equal to each other; and the negative pressure potential of the initial driving pulse and the negative pressure potential of each of the subsequent driving pulses are equal to each other.

6. The ink jet head of claim 3, wherein:

a pulse width of each of the driving pulses is set to be less than or equal to the natural period of the actuator; and a waveform holding time of a potential holding waveform of each of the driving pulses is set to be less than or equal to ¼ of the natural period of the actuator.

7. The ink jet head of claim 2, wherein the plurality of driving pulses include three or more rectangular driving pulses each composed of a potential increasing waveform which increases from a predetermined reference potential to a positive pressure potential for driving the actuator to pressurize the pressure chamber, a positive pressure potential holding waveform which holds the positive pressure potential, and a potential decreasing waveform which decreases from the positive pressure potential to a predetermined reference potential.

8. The ink jet head of claim 7, wherein:

the driving signal supply means is configured so as to sequentially supply at least first, second and third rectangular driving pulses during one printing cycle; and a first time t1 from an end potential increase in the first driving pulse to an end of potential increase in the second driving pulse, and a second time t2 from an end of potential increase in the second driving pulse to an end of potential increase in the third driving pulse, are set to satisfy $$t1 < t2 \leqq t0$$

with respect to the natural period t0 of the actuator.

9. The ink jet head of claim 7, wherein the rectangular driving pulses have an equal positive pressure potential and an equal reference potential.

10. The ink jet head of claim 7, wherein:

a time T1 from a start of potential increase in a first driving pulse to a start of potential increase in a last driving pulse in one printing cycle is set to satisfy $$T1/T2 \leqq 0.5$$

with respect to a minimum printing cycle T2.

11. The ink jet head of claim 3, wherein:

a time T1 from a start of potential decrease in the potential decreasing waveform of the initial driving pulse to an end of potential increase in a potential increasing waveform of a last subsequent driving pulse in one printing cycle is set to satisfy $$T1/T2 \leqq 0.5$$

with respect to a minimum printing cycle T2.

12. An ink jet head, comprising:

a head body which is provided with a pressure chamber containing ink and a nozzle communicated to the pressure chamber;

an actuator having a piezoelectric element for applying a pressure on the ink in the pressure chamber by a piezoelectric effect of the piezoelectric element; and driving signal supply means for supplying a driving voltage signal to the piezoelectric element of the actuator, wherein:

the driving signal supply means is configured so as to supply a plurality of driving pulses during one predetermined printing cycle; and a time interval between the driving pulses increases so as to gradually approach a predetermined time which is slightly longer than a natural period of the actuator so that a later discharged ink droplet has a higher discharge velocity than that of a previously discharged ink droplet.

13. An ink jet head, comprising:

a head body which is provided with a pressure chamber containing ink and a nozzle communicated to the pressure chamber;

an actuator having a piezoelectric element for applying a pressure on the ink in the pressure chamber by a piezoelectric effect of the piezoelectric element; and driving signal supply means for supplying a driving voltage signal to the piezoelectric element of the actuator, wherein:

the driving signal supply means is configured so as to supply a plurality of driving pulses during one predetermined printing cycle; and the plurality of driving pulses are supplied in such an order that a pulse width thereof gradually approaches a time which is equal to, or approximately equal to, one half of a natural period of the actuator so that a later discharged ink droplet has a higher discharge velocity than that of a previously discharged ink droplet.

14. The ink jet head of claim 13, wherein:

the driving voltage signal includes a negative pressure potential for driving the actuator to depressurize the pressure chamber, and a positive pressure potential for driving the actuator to pressurize the pressure chamber; and the plurality of driving pulses include:

an initial driving pulse composed of a potential decreasing waveform which decreases from a predetermined reference potential between a negative pressure potential and a positive pressure potential to the negative pressure potential, a negative pressure potential holding waveform which holds the negative pressure potential, and a potential increasing waveform which increases from the negative pressure potential to the positive pressure potential; and one or more subsequent driving pulses each composed of a positive pressure potential holding waveform which holds a positive pressure potential, a potential decreasing waveform which decreases from the positive pressure potential to a negative pressure potential, a negative pressure potential holding waveform which holds the negative pressure potential, and a potential increasing waveform which increases from the negative pressure potential to a positive pressure potential.

15. The ink jet head of claim 13, wherein:

the driving voltage signal includes a predetermined reference potential, and a negative pressure potential for driving the actuator to depressurize the pressure chamber; and the plurality of driving pulses include three or more driving pulses each composed of a potential decreasing waveform which decreases from a reference potential to a negative pressure potential, a negative pressure potential holding waveform which holds the negative pressure potential, and a potential increasing waveform which increases from the negative pressure potential to a reference potential.

16. The ink jet head of claim 13, wherein the plurality of driving pulses include three or more rectangular driving pulses each composed of a potential increasing waveform which increases from a predetermined reference potential to a positive pressure potential for driving the actuator to pressurize the pressure chamber, a positive pressure potential holding waveform which holds the positive pressure potential, and a potential decreasing waveform which decreases from the positive pressure potential to the reference potential.

17. The ink jet head of claim 13, wherein the plurality of driving pulses are supplied in such an order that a pulse width thereof gradually increases.

18. An ink jet head, comprising:

a head body which is provided with a plurality of pressure chambers containing ink and a plurality of nozzles communicated to the pressure chambers, respectively;

a plurality of actuators each having a piezoelectric element for applying a pressure on the ink in the respective pressure chambers by a piezoelectric effect of the piezoelectric element;

a driving signal production section for producing a reference driving signal including, in one predetermined printing cycle, N (N is a natural number equal to or greater than 2) ink discharging pulse signals for driving the actuators so as to discharge ink droplets from the nozzles; and a signal selection section for selectively supplying, to one of the actuators, P (P is a natural number less than or equal to N) ink discharging pulse signals included in the reference driving signal, wherein:

the ink discharging pulse signals of the reference driving signal are formed so that a later discharged ink droplet has a higher discharge velocity than that of a previously discharged ink droplet; and the signal selection section is configured so as to supply $N-P+1^{th}$ and subsequent ink discharging pulse signals of the reference driving signal.

19. The ink jet head of claim 18, wherein:

the driving signal production section produces an auxiliary pulse signal for suppressing meniscus vibration of the ink in the head body after producing the reference driving signal; and the signal selection section is configured so as to supply, to one of the actuators, the $N-P+1^{th}$ and subsequent ink discharging pulse signals and the auxiliary pulse signal.

20. The ink jet head of claim 19, wherein an interval between the $N^{th}$ ink discharging pulse signal of the reference driving signal and the auxiliary pulse signal is set to be 0.5 to 1.5 times a natural period of the actuators.

21. The ink jet head of claim 19, wherein a potential difference of the auxiliary pulse signal is set to be 0.1 to 0.3 times a minimum potential difference of the ink discharging pulse signals of the reference driving signal.

22. The ink jet head of claim 19, wherein:

each ink discharging pulse signal of the reference driving signal is composed of a potential decreasing waveform which decreases from a reference potential to a negative pressure potential for driving one of the actuators to depressurize one of the pressure chambers, a negative pressure potential holding waveform which holds the negative pressure potential, and a potential increasing waveform which increases from the negative pressure potential to the reference potential;

the auxiliary pulse signal is composed of a potential decreasing waveform which decreases from the reference potential to an auxiliary negative pressure potential for driving one of the actuators to depressurize one of the pressure chambers, a negative pressure potential holding waveform which holds the auxiliary negative pressure potential, and a potential increasing waveform which increases from the auxiliary negative pressure potential to the reference potential; and an interval between an end of potential increase in the potential increasing waveform in the $N^{th}$ ink discharging pulse signal of the reference driving signal and a start of potential decrease in the potential decreasing waveform of the auxiliary pulse signal is set to be 0.5 to 1 times a natural period of the actuators.

23. The ink jet head of claim 19, wherein:

the ink discharging pulse signals of the reference driving signal are each composed of:

an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials;

the auxiliary pulse signal is composed of a potential decreasing waveform which decreases from the reference potential to an auxiliary negative pressure potential for driving one of the actuators to depressurize one of the pressure chambers, a negative pressure potential holding waveform which holds the auxiliary negative pressure potential, and a potential increasing waveform which increases from the auxiliary negative pressure potential to the reference potential; and an interval between an end of potential increase in the potential increasing waveform in the last subsequent pulse signal of the reference driving signal and a start of potential decrease in the potential decreasing waveform of the auxiliary pulse signal is set to be 0.5 to 1 times a natural period of the actuators.

24. The ink jet head of claim 19, wherein:

the ink discharging pulse signals of the reference driving signal are each composed of:

an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases is from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials;

the auxiliary pulse signal is composed of a potential increasing waveform which increases from the reference potential to an auxiliary pressurizing potential for driving one of the actuators to pressurize one of the pressure chambers, a positive pressure potential holding waveform which holds the auxiliary positive pressure potential, and a potential decreasing waveform which decreases from the auxiliary positive pressure potential to the reference potential; and an interval between an end of potential increase in the potential increasing waveform in the last subsequent pulse signal of the reference driving signal and a start of potential increase in the potential increasing waveform of the auxiliary pulse signal is set to be 1 to 1.5 times a natural period of the actuators.

25. The ink jet head of claim 18, wherein:

each ink discharging pulse signal of the reference driving signal is composed of a rectangular or trapezoidal pulse signal having a first potential as a reference potential and a second potential which is different from the first potential;

the signal selection section is comprised of a switching circuit which is selectively switched to either one of an ON state where the reference driving signal is supplied to one of the actuators and an OFF state where the supply of the reference driving signal to the actuator is stopped; and the switching circuit is configured so as to be switched from the OFF state to the ON state while a potential of the reference driving signal is at the first potential.

26. The ink jet head of claim 18, wherein:

the ink discharging pulse signals of the reference driving signal are each composed of:

an initial pulse signal composed of a potential decreasing waveform which decreases from a reference potential, which is between a negative pressure potential for driving one of the actuators to depressurize one of the pressure chambers and a positive pressure potential for driving the actuator to pressurize the pressure chamber, to the negative pressure potential, a negative pressure potential holding waveform which holds the negative pressure potential, and a potential increasing waveform which increases from the negative pressure potential to the positive pressure potential; and one or more subsequent pulse signals each composed of a potential decreasing waveform which decreases from a respective one of predetermined positive pressure potentials to a respective one of predetermined negative pressure potentials, a negative pressure potential holding waveform which holds the respective one of the negative pressure potentials, and a potential increasing waveform which increases from the respective one of the negative pressure potentials to a respective one of predetermined positive pressure potentials;

the signal selection section is comprised of a switching circuit which is selectively switched to either one of an ON state where the reference driving signal is supplied to one of the actuators and an OFF state where the supply of the reference driving signal to the actuator is stopped; and the switching circuit is configured so as to be switched from the OFF state to the ON state after passage of a predetermined time from a start of waveform holding in the negative pressure potential holding waveform of the reference driving signal so that the supply of the reference driving signal is started after a potential of the reference driving signal has transitioned to the negative pressure potential.

27. The ink jet head of claim 18, wherein the reference driving signal is formed so that an interval between the N ink discharging pulse signals gradually approaches a natural period of the actuators while gradually increasing.

28. The ink jet head of claim 18, wherein the reference driving signal is formed so that potential differences in the N ink discharging pulse signals gradually increase.

29. An ink jet head, comprising:

a head body which is provided with a plurality of pressure chambers containing ink and a plurality of nozzles communicated to the pressure chambers, respectively;

a plurality of actuators each having a piezoelectric element for applying a pressure on the ink in the respective pressure chambers by a piezoelectric effect of the piezoelectric element;

a driving signal production section for producing a reference driving signal including, in one predetermined printing cycle, N (N is a natural number equal to or greater than 2) ink discharging pulse signals for driving the actuators so as to discharge ink droplets from the nozzles; and a signal selection section for selectively supplying, to one of the actuators, P (P is a natural number less than or equal to N) ink discharging pulse signals included in the reference driving signal, wherein:

the ink discharging pulse signals of the reference driving signal are formed so that a later discharged ink droplet has a higher discharge velocity than that of a previously discharged ink droplet;

the driving signal production section produces an auxiliary pulse signal for suppressing meniscus vibration of the ink in the head body after producing the reference driving signal; and the signal selection section is configured so as to supply the first ink discharging pulse signal of the reference driving signal when P is 1, and to supply the $N-P+1^{th}$ and subsequent ink discharging pulse signals of the reference driving signal and the auxiliary pulse signal when P is equal to or greater than 2.

30. The ink jet head of any one of claims 1 to 28, wherein a thickness of the piezoelectric element is set to be 0.5 $\mu$m to 5 $\mu$m.

31. An ink jet type recording apparatus, comprising:

the ink jet head of any one of claims 1 to 28; and relative movement means for relatively moving the ink jet head and a recording medium with respect to each other while the ink jet head discharges ink.

* * * * *